US005692313A

United States Patent [19]

Ikeda et al.

[11] Patent Number: 5,692,313

[45] Date of Patent: Dec. 2, 1997

[54] SPIN EXTRACTOR

[75] Inventors: Tomohiko Ikeda, Kusatsu; Yoshitaka Tsunomoto, Otsu; Masafumi Nishino, Kyoto, all of Japan

[73] Assignee: Sanyo Electric Co., Ltd., Osaka, Japan

[21] Appl. No.: 617,164

[22] Filed: Mar. 18, 1996

[30] Foreign Application Priority Data

Apr. 14, 1995 [JP] Japan ..... 7-113628

[51] Int. Cl.[6] ..... F26B 5/08; F26B 17/24; D06F 33/00

[52] U.S. Cl. ..... 34/58; 68/12.06; 34/319

[58] Field of Search ..... 34/58, 59, 312, 34/318, 319, 560, 573, 579; 68/12.06

[56] References Cited

U.S. PATENT DOCUMENTS

| | | | |
|---|---|---|---|
| 2,700,473 | 1/1955 | Emmert et al. | 34/319 |
| 3,339,732 | 9/1967 | Bergman | 34/319 |
| 3,346,115 | 10/1967 | Mellinger | 34/319 |
| 4,411,664 | 10/1983 | Rickard et al. | 8/158 |
| 4,765,161 | 8/1988 | Williamson | 68/12 |
| 5,301,523 | 4/1994 | Payne et al. | 68/12.16 |
| 5,345,792 | 9/1994 | Farrington et al. | 68/23.2 |

FOREIGN PATENT DOCUMENTS 6-254294 9/1994 Japan .

7-10095 2/1995 Japan .

*Primary Examiner*—Henry A. Bennett
*Assistant Examiner*—D. Doster
*Attorney, Agent, or Firm*—Oliff & Berridge

[57] ABSTRACT

In a spin extractor according to the present invention, a basket drum for containing fabric articles is provided with a balance weight in a portion of its inner peripheral wall, giving the drum its own eccentric load. The magnitude and position of the resultant eccentric load constituted by both the drum's own eccentric load and the fabric articles unevenly distributed therein is detected based on the fluctuations in the motor current. If the magnitude of the eccentric load is out of a predetermined range or if the position of the eccentric load is not in the proximity to the position opposite at an angle of 180° to the balance weight, the drum is rotated at such a speed that the centrifugal force acting on the fabric articles in the drum is smaller than the gravity force. Thus, the fabric articles are loosened, scattered and redistributed, and the magnitude and position of the eccentric load satisfy the required condition. The above-mentioned range is predetermined based on the magnitude of the eccentric load that causes no abnormal vibration in the extracting operation, taking account of both the weight of the balance weight and the decrease in the weight of the fabric articles through the extracting operation. After the magnitude and position of the eccentric load are settled to satisfy the required condition, the drum is rotated at full speed to extract liquid from the fabric articles.

15 Claims, 16 Drawing Sheets

BEFORE EXTRACTING OPERATION

IN OSCILLATING OPERATION

IN DETECTING ECCENTRIC LOAD

BEFORE EXTRACTING OPERATION

IN LOOSENING OPERATION

WHEN TEMPORARILY HALTED

IN DETECTING ECCENTRIC LOAD

BEFORE EXTRACTING OPERATION

IN OSCILLATING OPERATION

BEFORE DETECTING ECCENTRIC LOAD

IN DETECTING ECCENTRIC LOAD

BEFORE EXTRACTING OPERATION

IN DETECTING ECCENTRIC LOAD

SPIN EXTRACTOR

The present invention relates to a spin extractor for extracting liquid (such as water or dry cleaning solvent) from wet fabric articles by rotating a drum with the fabric articles contained therein at high speed about a horizontal axis.

BACKGROUND OF THE INVENTION

In a drum type (or a front loading type) spin extractor, wet fabric articles are contained in a basket drum after washed and rinsed, and the drum is rotated at high speed about the horizontal axis. The spin extractor of this type is accompanied by some serious problems, one of which is the abnormal vibration and noise that occur due to the unbalanced load around the axis when the drum is rotated at high speed with fabric articles unevenly distributed on the inner peripheral wall thereof.

Some spin extractors have been proposed for solving the above problem. For example, in the spin extractor disclosed in the Japanese Published Unexamined Patent Application No. H6-254294, the drum is initially rotated at a low speed to distribute fabric articles evenly in the drum, whereafter the extracting operation is carried out at a high speed. In concrete, the fabric articles are distributed by a process comprising two rotation control steps: first, the drum is rotated at a low speed for a short period of time; second, the drum is rotated at another low speed that is a little higher than said low speed but is much lower than a full speed for carrying out the extracting operation.

In the above spin extractor, a vibration sensor is provided on the pedestal of the machine to detect the unbalanced load. When the speed is increased to the full speed for carrying out the extracting operation and an abnormal vibration is detected by the vibration sensor, the speed is lowered.

In the above method, though, it is not assured that the fabric articles are redistributed evenly in the drum by just one attempt of rotating the drum at the lower speeds. When the abnormal vibration is still detected if the drum is rotated again at the full extracting speed after an attempt of the redistribution at the low speeds, the drum must be rotated again at the low speeds to try redistribution of the fabric articles. If the cycle of redistributing the fabric articles at the low speeds and of detecting the unbalance at the full extracting speed is repeated a plurality of times, the time necessary for the extracting process becomes too long which is against the initial object.

Furthermore, when the drum is rotated so that the fabric articles are distributed evenly in the drum, as in the above-described prior art, a "tug of war" may occur among the fabric articles, particularly to lengthy fabric articles, through an entanglement at the central part of the drum. In this case, when the extracting operation is continued further, the fabric articles may be torn eventually.

On the other hand, the Japanese Published Examined Patent Application No. H7-100095 discloses a spin extractor comprising a balance weight attached to a portion of an inner peripheral wall of a drum. In this spin extractor, the drum speed is increased from a low speed to a full extracting speed when the balance weight comes to the top, assuming that the fabric articles are gathered by the gravity force at the bottom at that time and the load balance is attained. This method, however, does not ensure that the load balance between the balance weight and the fabric articles is adequately attained before entering the extracting operation, and an abnormal vibration cannot be prevented completely. The above spin extractor might be effective under certain conditions where the weight of fabric articles thrown in the drum should be adjusted to be within a narrow range predetermined according to the weight of the balance weight. Such a spin extractor, however, is far from practical use.

SUMMERY OF THE INVENTION

The present invention is accomplished to solve the above problem, and one of the objects is to provide a spin extractor that can extract liquid such as water or dry cleaning solvent from fabric articles efficiently, avoiding an abnormal vibration in the extracting operation, and moreover, preventing the fabric articles from being torn in the extracting operation.

A common feature of the spin extractors according to the present invention is that the drum has its own eccentric load. It is not aimed in the present invention that the fabric articles themselves are distributed evenly in the drum, as in the conventional art. But the drum is rotated at the full extracting speed when the load balance including both the load of the fabric articles and the eccentric load of the drum is judged to be in a predetermined allowable state.

The first type of spin extractor according to the present invention comprises: a fixed weight attached to a drum for providing a fixed eccentric load to the drum, a motor for rotating the drum; detecting means for detecting a magnitude and a position of a resultant eccentric load composed of the fixed eccentric load of the drum and a load by fabric articles contained in the drum; judging means for judging whether the magnitude of the resultant eccentric load is within a predetermined range and whether the position of the resultant eccentric load is within a predetermined proximity to a predetermined position; and speed control means for driving the motor to rotate the drum at a first speed for performing an extracting operation on the fabric articles if the magnitude of the resultant eccentric load is judged to be within the predetermined range and the position of the resultant eccentric load is within the predetermined proximity to the predetermined position, and for driving the motor to rotate the drum at a second speed for redistributing the fabric articles in the drum if the magnitude of the resultant eccentric load is judged to be not within the predetermined range or the position of the resultant eccentric load is judged to be not within the predetermined proximity to the predetermined position.

Said predetermined range for judging the magnitude of the resultant eccentric load is determined beforehand taking account of the eccentric load permissible after the extracting operation, the drum's own eccentric load and the decrease in the weight of the fabric articles due to the extracting operation. Said predetermined proximity for judging the position of the resultant eccentric load is determined beforehand taking account of the position of the drum's own eccentric load. In concrete, they are predetermined so that an eccentric load never causes abnormal vibration even after the liquid is extracted if the eccentric load meets the predetermined condition of magnitude and position.

Next, the second type of spin extractor according to the present invention comprises: a variable weight attached to a drum for providing a variable eccentric load to the drum; a motor for rotating the drum; detecting means for detecting a magnitude and a position of a resultant eccentric load composed of the eccentric load of the drum and a load by fabric articles contained in the drum; adjusting means for adjusting the variable weight according to the magnitude of the resultant eccentric load detected by the detecting means at a time when a magnitude of the variable weight is zero if the position of the resultant eccentric load is within a predetermined proximity to a position determined with respect to the position of the variable weight in the drum at a time when the magnitude of the variable weight is zero; and speed control means for driving the motor to rotate the drum at a speed for performing an extracting operation on the fabric articles if the magnitude of the resultant eccentric load is detected to be within a predetermined range after the variable weight is adjusted by the adjusting means.

In the above spin extractor, no eccentric load is provided to the drum itself when the fabric articles are set in the drum to start the extracting process. Accordingly, the detecting means first detect the eccentric load due only to the uneven distribution of the fabric articles. When the eccentric load detected thereby is within the predetermined proximity to the position determined with respect to the position of the variable weight, it is possible to correct the balance of the drum during extracting operation by increasing the variable weight. Therefore, the adjusting means provide an eccentric load to the drum itself by increasing the variable weight, and stop increasing the weight when the resultant eccentric load detected by the detecting means is brought within the predetermined allowable range. In a preferable case, when the eccentric load due only to the fabric articles is not in the predetermined proximity to the position determined with respect to the position of the variable weight, the speed control means drive the motor to rotate the drum so that the fabric articles are distributed and the position of the eccentric load thereof comes in the predetermined proximity to the predetermined position.

In either of the above first and second spin extractors, any of the following various methods can be used to distribute fabric articles appropriately.

In the first method, the system is further provided with rotational position detecting means for detecting the rotational position of the drum, and the speed control means drive the motor to rotate the drum at a speed within a range where a centrifugal force acting on the fabric articles is smaller than a gravity force acting thereon referring to the rotational position of the drum.

In the second method, the speed control means vary the speed of the drum within a range where a centrifugal force acting on the fabric articles is larger than a gravity force acting thereon. Here, it is particularly preferable to set the range at a little higher than a speed where the centrifugal force acting on the fabric articles is equal to the gravity force acting thereon. By this method, when the fabric articles pressed on the inner peripheral wall of the drum are circling around, the centrifugal force acting thereon varies, exerting a force to slide the fabric articles, so that the fabric articles can be distributed around the predetermined position.

In the third method, the speed control means oscillate the drum forward and backward for a predetermined period of time, maintaining the position of the eccentric load of the drum above the center of the drum, in the initial phase of the extracting process, and then increase the speed of the drum until a centrifugal force acting on the fabric articles becomes a little larger than a gravity force acting thereon. Here, in order to distribute the fabric articles efficiently, it is particularly preferable to carry out the following two oscillating operations alternately: one to oscillate the drum with an angle larger than 90°, and the other to oscillate the drum with an angle smaller than 90°.

In detail, each fabric article has its own water absorbing ratio depending on such factors as the type of constituent fabric or type of knitting, therefore, usually, different fabric articles in the drum have different weight-decreasing ratios. By the above oscillating operation, some fabric articles retaining a lot of water sink onto the bottom of the drum while the other retaining little water emerge up, even if both are gathered and crammed at the bottom of the drum initially. Next, during the accelerating phase, the fabric articles positioned closer to the center of the drum fall down in the course of the rotation. As a result, most of the fabric articles gathered at a position opposite at an angle of 180° to the weight portion retain a lot of water, whereas the fabric articles retaining little water are distributed on the rest of the inner peripheral wall surface. In short, the fabric articles are separated by the amount of water retained therein, thus the eccentric load of the drum can be brought within a desired range. Accordingly, the position of eccentric load hardly shifts even when the drum is rotated at a high speed in the extracting operation, the decreasing rate of weight of fabric articles can be estimated beforehand more easily, so that the reference range for judging the magnitude of the eccentric load can be predetermined more simply.

In the fourth method, the speed control means carry out the following sequential process: first, to rotate the drum for a predetermined period of time at a speed within a range where a centrifugal force acting on the fabric articles is smaller than a gravity force acting thereon; second, to decrease the speed until the drum completely halts or nearly halts; and third, starting from the state where the position of the fabric articles is in opposition to the eccentric load of the drum, to increase the speed of the drum to a speed where the centrifugal force is larger than the gravity force.

In detail, the fabric articles, retaining a lot of water and lying at the bottom of the drum, are creed and entangled with one another after washed and rinsed. The fabric articles, however, are stirred up and get disentangled by rotating the drum at a speed where the gravity force is larger than the centrifugal force, as described above, and moreover, the total volume of the fabric articles is increased thereby since air is introduced between the fabric articles as well as inside each fabric article. As a result, the difference between the two distances, one between a fabric article positioned closer to the center of the drum and the rotation axis of the drum, the other between a fabric article positioned closer to the inner peripheral wall and the same axis, increases, and the fabric articles lying on the top of the pile in the drum, i.e., those positioned closer to the center of the drum, come off more easily since the centrifugal force acting thereon becomes relatively weak. Furthermore, since the air is introduced between the fabric articles, one fabric article can come off the other easily, therefore the fabric articles can be distributed more easily.

In the above spin extractor, it is further appreciated to constitute the detecting means so that the magnitude of the eccentric load is detected from an amplitude of fluctuations in an electric current to the motor, and the position of the eccentric load is detected from a position of a peak in the fluctuations. Here, since the fluctuations in the electric current are more distinct and easier to detect as the speed of the drum is set lower, it is preferable to judge the state of eccentric load at such a speed as is just a little higher than a speed where a centrifugal force acting on the fabric articles is equal to a gravity force acting thereon. By this method, the magnitude and position of the eccentric load can be detected precisely, so that the judgement on whether the eccentric load is within a range where the abnormal vibration does not occur even in the extracting operation becomes more reliable.

In the above second type of spin extractor, the variable weight may consist of a pocket with a liquid such as water contained therein and the variable weight may be varied by changing the amount of the liquid, thus varying the drum's own eccentric load. In order to make the structure of the variable weight simple, the pocket may be formed in a baffle, a plurality of which are usually provided in the drum. Further, the pocket may comprise a liquid port formed at such a position that the liquid is kept inside by a centrifugal force acting on the liquid when the drum is rotating at a speed where a centrifugal force acting on the fabric articles is larger than the gravity force acting on the fabric articles and that the liquid is discharged through the liquid port when the drum is rotated at a speed where the centrifugal force acting on the fabric articles is smaller than the gravity force acting on the fabric articles, whereby the state of the drum can be easily restored back to the initial state without the eccentric load by discharging the liquid contained in the pocket through the liquid port after the extracting operation is finished.

As described above, by the first type of spin extractor according to the present invention, the abnormal vibration and noise can be avoided surely in the liquid extracting operation since the drum is rotated at a high speed for carrying out the liquid extracting operation only when the eccentric load that is detected prior to the liquid extracting operation is within such an allowable range that the eccentric load after the liquid extracting operation can be brought within a desired range. Particularly, since the eccentric load in the drum is balanced taking account of an eccentric load that is provided to the drum itself, the allowable range for eccentric load that is detected before the liquid extracting operation can be determined wider. Accordingly, the fabric articles can be redistributed easily in the state where no abnormal vibration occurs in the liquid extracting operation, thus improving the extracting efficiency. Further, since the extracting operation is carried out with the fabric articles unevenly distributed in the drum, it is less probable that the fabric articles get entangled in the center of the drum, hence the "tug of war" is less expected to occur among the fabric articles.

In the second type of spin extractor, further, what is required is to correct only the position of the eccentric load due to the uneven distribution of fabric articles so that it comes in a predetermined proximity to the predetermined position, and the magnitude of the eccentric load can be balanced with the variable weight later. Therefore, by the second type of spin extractor, the fabric articles can be redistributed more easily and hence the liquid extracting operation can be accomplished in a shorter time than by the first type.

DESCRIPTION OF PREFERRED EMBODIMENTS

Figure 1A:
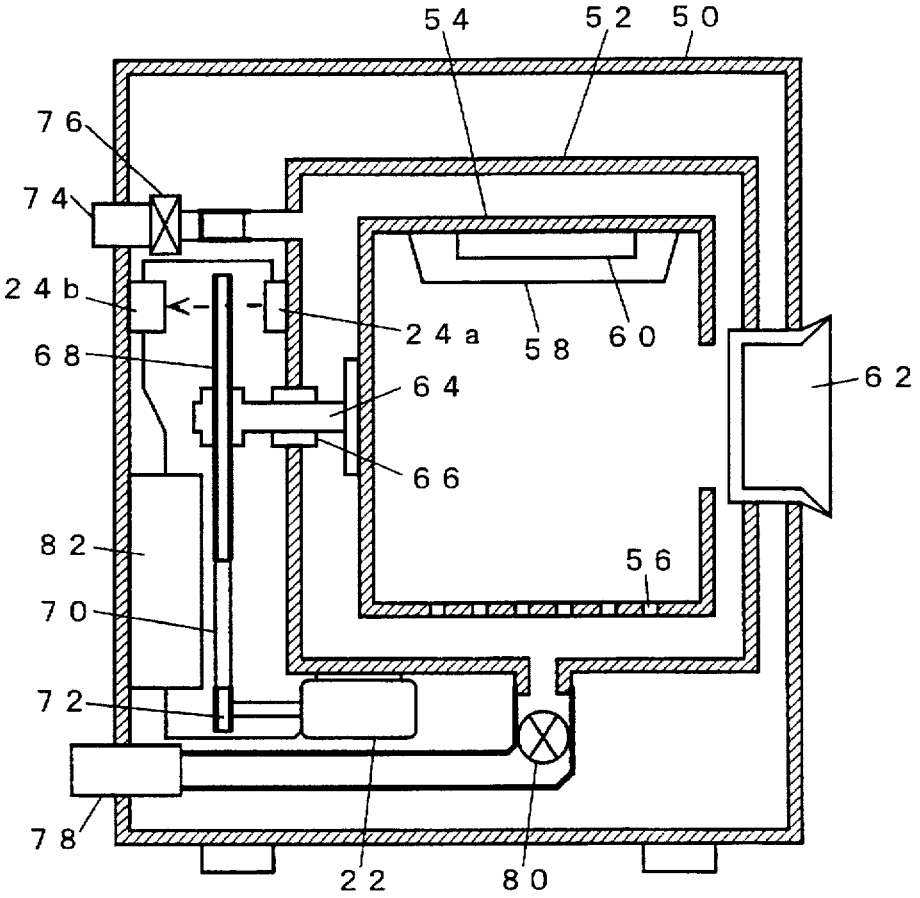
FIG. 1A is a vertical cross sectional view showing the whole structure of a drum type washing machine comprising a spin extractor according to the present invention.
Figure 1B:
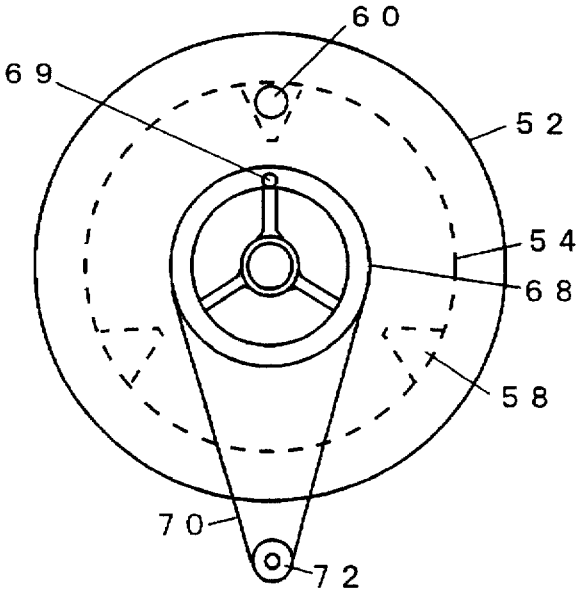
FIG. 1B shows a rear view of the drum and its driving mechanism.

The first embodiment of the present invention is described as follows. FIG. 1A shows a vertical cross section of a drum type washing machine comprising a spin extractor according to the present invention, and FIG. 1B shows a rear view of the drum and its driving mechanism.

A tub 52 is disposed within an outer case 50. A drum 54 for containing fabric articles, sustained by a main shaft 64, is provided within the tub 52. Perforations 56 are formed in the peripheral wall of the drum 54 so that the water supplied in the tub 52 comes in the drum 54 and the water extracted from fabric articles goes out of the drum 54 therethrough. Three baffles 58 for lifting fabric articles in accompany with the rotation of the drum 54 are provided on the inner peripheral wall of the drum 54 at angular intervals of 120°. A balance weight 60 for giving a fixed eccentric load to the drum 54 is provided inside of one of the baffles 58. Fabric articles are thrown into the drum 54 through an opening 62.

The main shaft 64 is supported by a bearing 66 fixed in the tub 52, and the main shaft 64 is provided with a main pulley 68 at its end. A motor 22 for rotating the drum 54 is placed beneath the tub 52, and the motor 22 is provided with a motor pulley 72 on its shaft. The motor pulley 72 and the main pulley 68 are drivingly connected by a V belt 70. The washing water and the rinsing water are supplied from outside through a water inlet 74 to the tub 52, and the flow rate of the water is regulated by a water-supply valve 76. The water in the tub 52 used in washing or rinsing, or the water extracted from the fabric articles, is drained through a drain outlet 78 which is opened and closed by a drainage valve 80. A circuit unit 82 applies a driving voltage to the motor 22. The circuit unit 82 includes a controller 10, an inverter control circuit 20 and other related circuits, which will be detailed later. A rotation sensor consists of a photo-emitter 24*a* and a photo-receiver 24*b*: the photo-emitter 24*a* fixed to the tub 52 faces the photo-receiver 24*b* fixed to the inner wall of the outer case 50 across the main pulley 68. An opening 69 is formed in the annular rim of the main pulley 68 between the photo-emitter 24*a* and the photo-receiver 24*b*. A light from the photo-emitter 24*a* passes the opening 69 and reaches the photo-receiver 24*b* only once in each rotation of the drum 54. Thus the photo-receiver 24*b* of the rotation sensor generates a detection signal (which is also referred to as a rotation marker) synchronized with the rotation of the drum 54.

Figure 2:
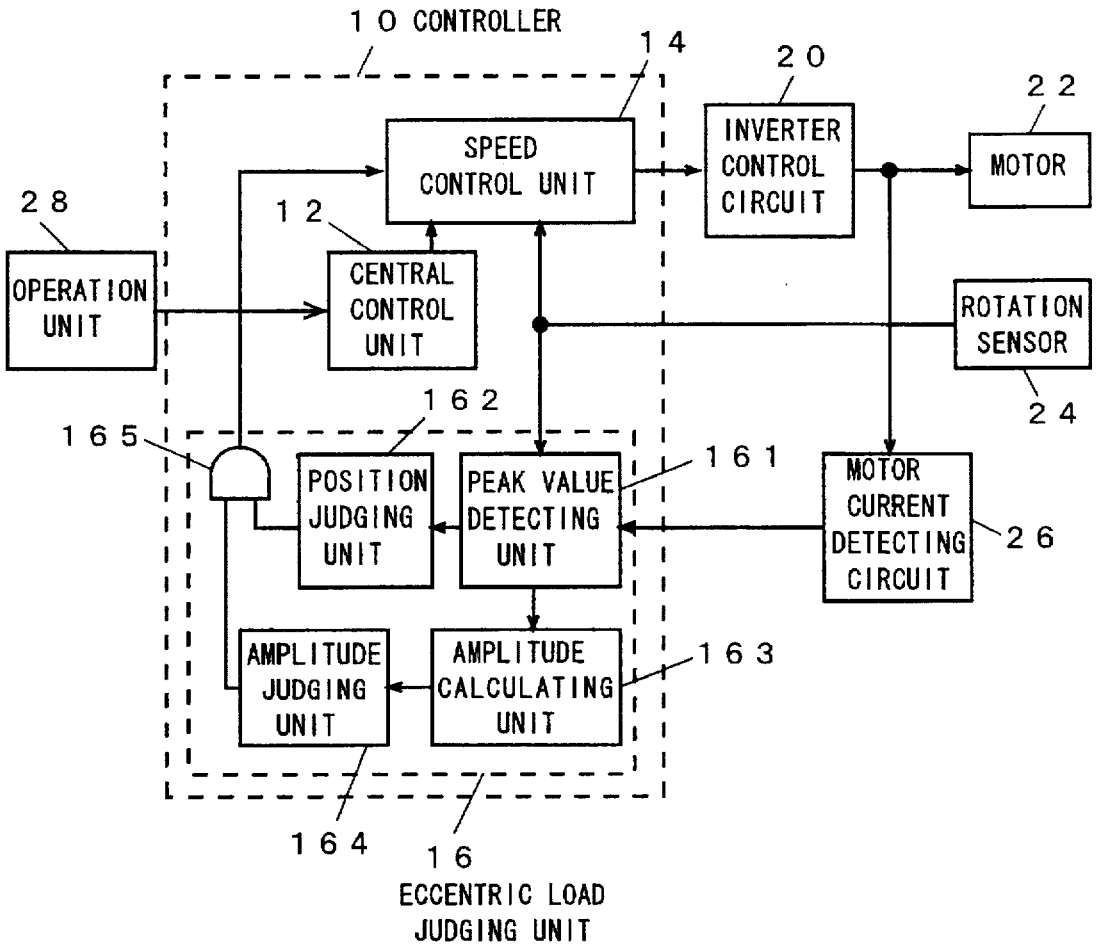
FIG. 2 is a schematic block diagram showing the electric system of the drum type washing machine of FIG. 1.

Next, the constitution and operation of the electric system is described referring to FIG. 2, whose main portion is included in the circuit unit 82. The controller 10 including several microcomputers is composed of a central control unit 12, a speed control unit 14 and an eccentric load judging unit 16. The eccentric load judging unit 16 consists of a peak value detecting unit 161, a position judging unit 162, an amplitude calculating unit 163, an amplitude judging unit 164 and an AND gate 165. Beside the controller 10, the circuit unit 82 is provided with the inverter control circuit 20, the rotation sensor 24, a motor current detecting circuit 26 and an operation unit 28.

Programs for conducting a laundry job including a washing process, a rinsing process and an extracting process are stored in a memory of the central control unit 12 beforehand. When a user operates a key or keys on the operation unit 28 to select one of several extracting modes according to, for example, the type of constituent fabric of the article, and operates a key to start the extracting process, the central control unit 12 reads out the program corresponding to the selected mode from the memory and executes the program to perform the extracting process.

The speed control unit 14 outputs a speed designating signal to the inverter control circuit 20 according to the program selected, wherein the speed designating signal designates also the rotating direction of the drum 54. The inverter control circuit 20 converts the speed designating signal into a pulse width modulated (PWM) signal and applies a driving voltage corresponding to the PWM signal to the motor 22. Thus, the speed control unit 14 and the inverter control circuit 20 combined perform as the speed control means.

Figure 3:
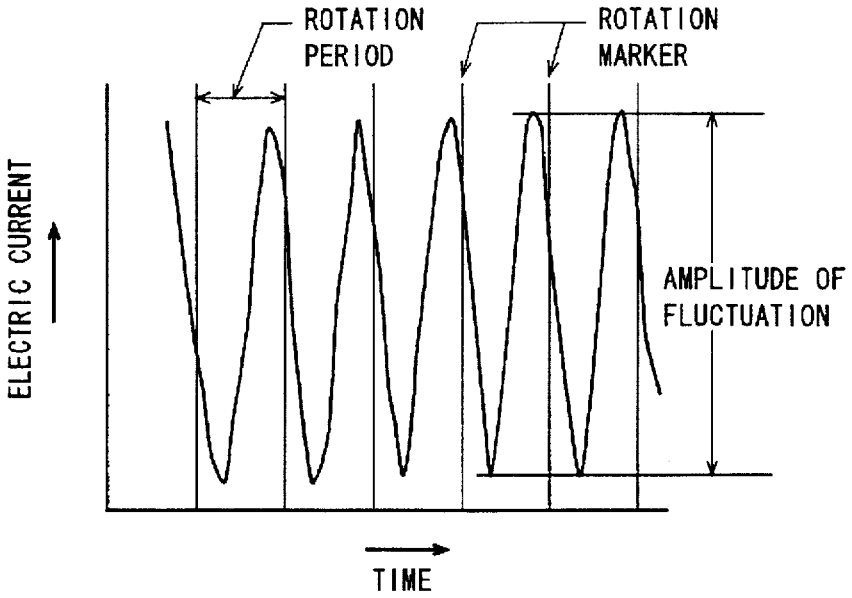
FIG. 3 is a graph showing fluctuations in the motor current.
Figure 4:
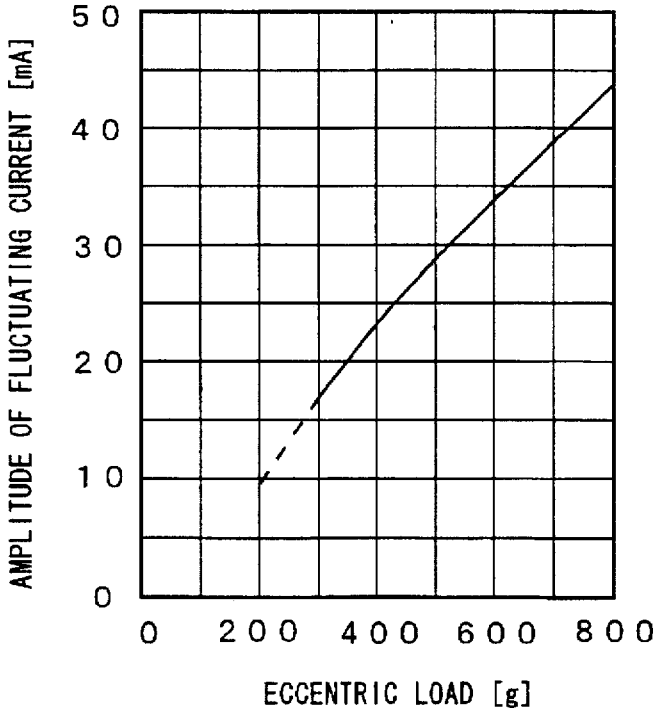
FIG. 4 is an example of a graph showing the relation between the magnitude of eccentric load and the amplitude of fluctuations in the motor current.

The electric current to the motor 22 is detected by the motor current detecting circuit 26, whose detection signal is sent to the eccentric load judging unit 16. If an eccentric load exists in the drum 54, fluctuations due to the eccentric load is detected in the motor current. FIG. 3 shows an example of a waveform representing the effective value of the motor current. In this graph, a rotation marker is a signal indicating each rotation of the drum 54, which is generated by the rotation sensor 24 as described above. As shown in FIG. 3, the fluctuations in the motor current is synchronized with the rotation cycle of the drum 54 if an eccentric load exists, i.e., a positive and negative peak or peaks in the fluctuations in the motor current appear at almost the same position in relation to the rotation marker in each rotation of the drum 54. The position of a positive peak in one cycle corresponds to the position in the drum where the eccentric load exists. The amplitude of the fluctuations in the motor current corresponds to the magnitude of the eccentric load. FIG. 4 is an example of the graph showing the relation between values of preset known magnitude of the eccentric load and values of amplitude of the fluctuations in the motor current. Using such a graph, the magnitude of an eccentric load can be inferred from the amplitude of the fluctuations in the motor current. Since there are various factors that cause fluctuations in the motor current other than the eccentric load, it is preferable to filter out a component having frequency close to that corresponding to the speed of the drum 54 from the fluctuations, whereby the amplitude of the fluctuations due to the eccentric load can be measured more precisely.

The eccentric load judging unit 16 calculates the magnitude of the eccentric load, referring to the detection signal from the motor current detecting circuit 26, and judges the loading state as follows. The peak value detecting unit 161 detects both a positive peak and a negative peak in the fluctuations in the motor current in each interval of the rotation markers generated by the rotation sensor 24 (i.e. in each rotation cycle of the drum 54). The data of the positions of the positive and negative peaks are sent to the position judging unit 162 and the data of the amplitude of the peaks is sent to the amplitude calculating unit 163.

The position of the positive peak corresponds to that of the eccentric load. Hence, the position judging unit 162 first detects the delay time from the rotation marker to the positive peak, then, referring to the delay time, calculates the position of the eccentric load on the inner peripheral wall of the drum 54. When the position of the eccentric load is judged to be in the proximity to a desirable position, the position judging unit 162 outputs a high level signal. Here, said desirable position is the position opposite at an angle of 180° to the balance weight 60, and an allowable range is predetermined in the proximity to said desirable position, taking account of such factors as the error in detecting the position and the unevenness in the distribution of the fabric articles.

The amplitude calculating unit 163 calculates the amplitude of the fluctuations in the motor current in each rotation cycle of the drum 54, referring to the positive and the negative peak values. As shown in FIG. 4, the amplitude corresponds to the magnitude of the eccentric load. Therefore, judging on the amplitude of fluctuations renders the same result as judging on the magnitude of the eccentric load. Hence, the amplitude judging unit 164 judges whether the amplitude is within a predetermined range, and outputs a high level signal if the amplitude is within the predetermined range. Here, said predetermined range, as detailed later, is an allowable range determined beforehand regarding such factors as an allowable magnitude of the eccentric load after the extracting operation, and the weight of the balance weight 60.

The results of the judgement on the position and magnitude of the eccentric load are given to the AND gate 165 which outputs the logical product of the two results. The AND gate 165 sends a high level signal to the speed control unit 14 only when the magnitude of the eccentric load is within the predetermined range and its position is opposite at an angle of substantially 180° to the balance weight 60. When the speed control unit 14 receives the results of the judgement while it is controlling the motor 22 to rotate the drum 54 at a predetermined speed (to be described later), it changes the speed designating signal according to said results of the judgement on the eccentric load.

Figure 5A:
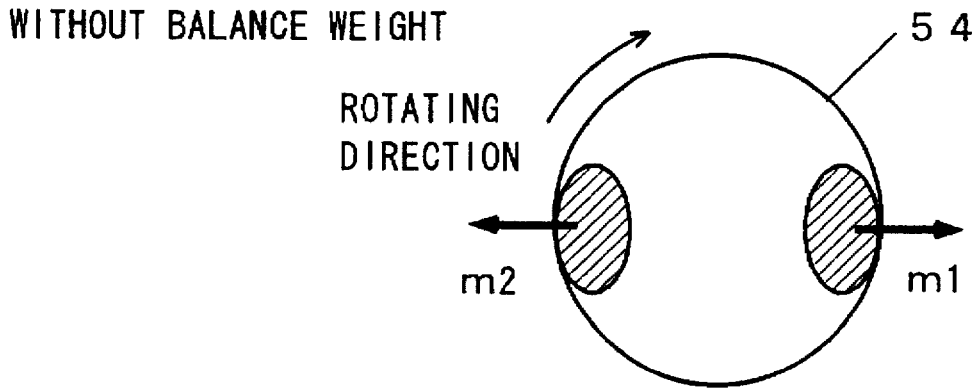
FIGS. 5A and 5B illustrate the difference in the allowable range for the eccentric load between the case where a balance weight is not provided in the drum and the case where the balance weight is provided.
Figure 5B:
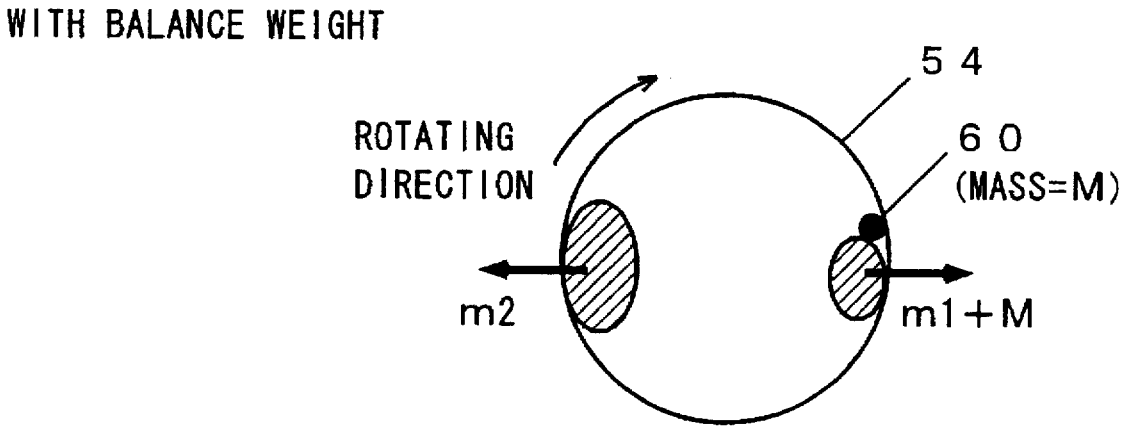

Next, the difference in the allowable range of the magnitude of the eccentric load is explained referring to FIGS. 5A and 5B between a case where a drum has its own eccentric load as in the present invention and the conventional case where a drum has no eccentric load. It is supposed here that the minimum magnitude of the eccentric load that causes an abnormal vibration in the extracting operation is 100[g], and that the weight of a fabric article after an extracting operation decreases to ½ of that before the extracting operation.

(i) When the drum has no its own eccentric load

When an eccentric load is constituted, as in FIG. 5A, of two unbalanced wet fabric articles having different weights of m1 and m2 before an extracting process located opposite to each other across the center axis of the drum, the condition for causing no abnormal vibration in the extracting process is given by the following formula:

$$|m1-m2|/2 \leqq 100 \quad (1),$$

which is rewritten as $$|m1-m2| \leqq 200 \quad (2).$$

The formula (2) shows that an abnormal vibration can be avoided in an extracting operation if the fabric articles are distributed so that the eccentric load is settled under 200 [g] before the extracting process.

(ii) When the drum has its own eccentric load of weight M [g]

When an eccentric load is constituted, as in FIG. 5B, of two wet fabric articles having different weights of m1 and m2 before the extracting operation and the balance weight 60 of M[g], the condition for causing no abnormal vibration in the extracting operation is given by the following formulae:

$$(m2/2)-[(m1/2)+M] \leqq 100 \quad (3),$$

$$[(m1/2)+M]-(m2/2) \leqq 100 \quad (4).$$

Supposing that M=300 [g], the two formulae can be combined as follows:

$$400 \leqq m2-m1 \leqq 800 \quad (5).$$

From the formula (5), the allowable range of the magnitude of eccentric load before the extracting process can be given as follows:

$$100 \leqq m2-(m1+M) \leqq 500 \quad (6).$$

(iii) Difference between case (i) and case (ii) in respect of the allowable range By comparing formula (2) with formula (6), it is shown that the allowable range of the magnitude of the eccentric load before the extracting process is doubled by attaching the weight to the drum. Therefore, the operation for bringing the eccentric load within the allowable range by scattering and redistributing fabric articles in the drum becomes easier.

(iv) Difference between case (i) and case (ii) in respect of precision in detecting the eccentric load In the above-described method of detecting the eccentric load based on the fluctuations in the motor current, the precision in detection becomes poor when the eccentric load is small, and when the eccentric load is less than a certain value, the eccentric load is no longer detectable due to other disturbing factors. In FIG. 4, for example, the eccentric load under 200 [g] is impossible to detect, and the eccentric load between 200 to 300 [g] cannot be detected precisely and the detected result is unreliable. Therefore, practically, it is very difficult to redistribute the fabric articles for the formula (2) to be satisfied.

If the minimum eccentric load that can be detected assuredly is 300 [g] in the above case (ii), the condition for detecting an eccentric load before an extracting process is given as follows:

$$m2-(m1+M) \geqq 300 \quad (7).$$

If M=300 [g], the allowable range of an eccentric load that is detectable before the extracting process and further causes no abnormal vibration is given as follows:

$$300 \leqq m2-(m1+M) \leqq 500 \quad (8).$$

The above formula shows that, by providing a weight to the drum, the allowable range of an eccentric load before the extracting process is shifted to the position where the eccentric load can be detected more easily or more precisely.

As described above, when the drum 54 has its own eccentric load by the balance weight 60 attached thereto, the following two advantages can be obtained:

1) the allowable range of the magnitude of the eccentric load is wider, so that the eccentric load comes within the allowable range with higher probability when the fabric articles are redistributed in the drum; and 2) the allowable range of the magnitude of the eccentric load before the extracting process can be set at such a position where the eccentric load is detected more precisely, so that the abnormal vibration occurring in the extracting process due to a wrongly admitted eccentric load can be avoided.

In addition, the allowable range of the magnitude of the eccentric load before the extracting process can be varied by changing the weight of the balance weight 60, which is supposed to be 300 [g] in the above example. In general, when the eccentric load after the extracting process is to be settled under P[g], the allowable range of the eccentric load before the extracting process is given by the following formula:

$$M-2 \leqq m2-(m1+M) \leqq M+2P \quad (9).$$

Provided that the minimum detectable eccentric load is Q [g], the allowable range of the eccentric load that is detectable before the extracting process and causes no abnormal vibration in the extracting process is given by the following formula:

$$Q \leqq m2-(m1+M) \leqq M+2P \quad (10).$$

It should be noted that the formula (10) cannot be satisfied when the total weight of the fabric articles is under (M+Q) [g]. Accordingly, the weight of the fabric articles must be equal to or larger than (Q+M) [g].

Figure 6:
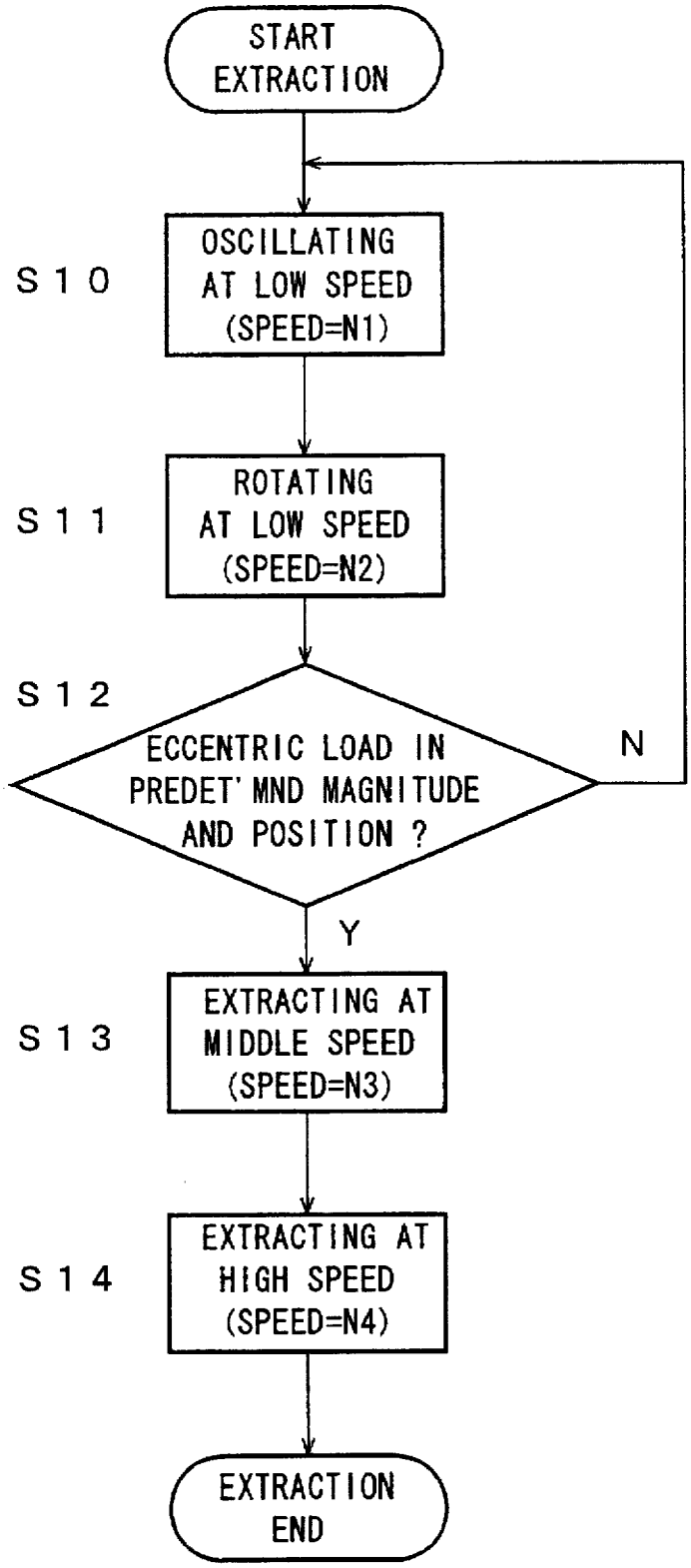
FIG. 6 is a flow chart showing a process of controlling the extracting operation in one embodiment of the present invention.

The process of carrying out the extracting operation is explained as follows, referring to the flow chart of FIG. 6. Here, the weight of the balance weight is assumed to be 300 [g] and the maximum eccentric load allowable after the extracting process be 100 [g].

Figure 7A:
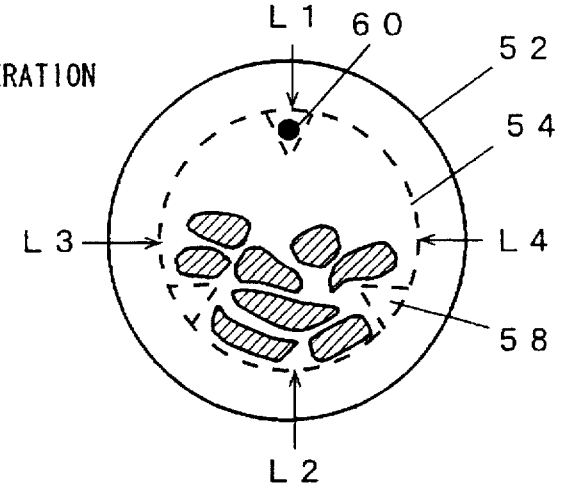
FIGS. 7A, 7B and 7C illustrate a movement of the fabric articles in the drum in the extracting operation by the process of the flow chart of FIG. 6.
Figure 7B:
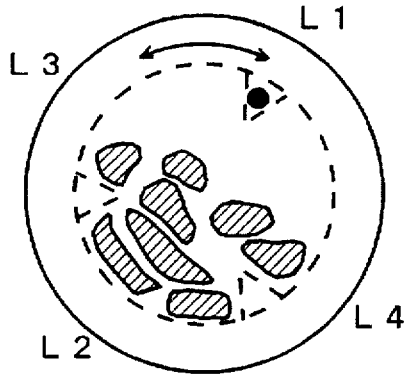

The distribution of fabric articles in the drum 54 is as shown in FIG. 7A at the beginning of the extracting process after the rinsing process is finished. Starting from there, the drum 54 is oscillated to correct the eccentric load so that it satisfies the above formula (8) (step S10). Here, the fabric articles are required to be distributed so that the eccentric load thereof comes between 300 and 500 [g] before the extracting process and is positioned in the proximity to a position L2 which is opposite at an angle of 180° to the position L1 of the balance weight 60. Hence, a low speed oscillating operation is first carried out, wherein the drum 54 is rotated forward and backward alternately at a considerably low speed N1, for example at 10–20 [r.p.m.], with a rotational amplitude of 180°, maintaining the position of the balance weight 60 above the center of the drum 54, whereby the fabric articles are distributed in the area between a position L3 and a position L4 in the drum 54, centering around the position L2 (FIG. 7B).

In the oscillating operation, the speed control unit 14 outputs a speed designating signal to rotate the drum 54 at a low speed N1, detects the position of the balance weight 60 by referring to a signal from the rotation sensor 24, and instructs the inverter control circuit 20 to reverse the rotating direction of the drum 54 at every 180° angle, maintaining the position of the balance weight 60 above the center of the drum 54. The inverter control circuit 20 applies voltage to the motor 22 according to the instruction.

The rotating direction is reversed several times in the low speed oscillating operation. After that, the low speed rotation step is carried out (step S11). In step S11, the speed control unit 14 outputs a speed designating signal so that the drum 54 is rotated in the same direction as in the extracting operation at a low speed N2 which is a little higher than a speed where the centrifugal force acting on the fabric articles in the drum 54 is equal to the gravity force. The inverter control circuit 20 applies voltage to the motor 22 according to the speed designating signal. The low speed N2 is set at about 50 [r.p.m.] when the diameter of the drum is 700 [mm], and at about 86 [r.p.m.] when the diameter is 910 [mm], for example.

Figure 7C:
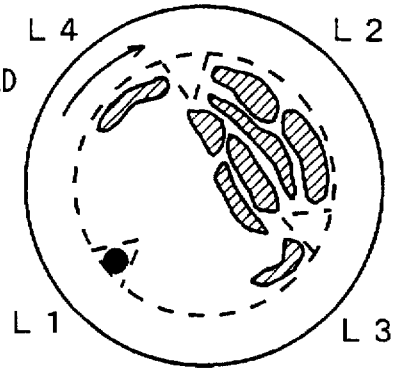

After the speed of the drum 54 is increased to the low speed N2, the fabric articles are pressed on the inner peripheral wall of the drum 54 (FIG. 7C). There, the eccentric load judging unit 16 judges the magnitude and position of the eccentric load as described above. In concrete, the eccentric load judging unit 16 detects the magnitude and position of the eccentric load based on the amplitude of fluctuations in the motor current detected by the motor current detecting circuit 26 and judges whether the magnitude of the eccentric load is within the range of 300–500 [g] and the position of the eccentric load is within the range predetermined in the proximity to the position L2 (step S12).

Provided that wet fabric articles weighing 1 [kg] in total are contained in the drum 54, and they are distributed by the oscillating operation of step S10 into the state in which no fabric article is placed at the position L1, 800 [g] of them are placed at L2, 100 [g] of them are placed at L3 and 100 [g] of them are placed at L4. The magnitude of the eccentric load is 500 [g] and the position thereof is in the proximity to the position L2 in this case. Therefore, the eccentric load judging unit 16 outputs a high level signal to the speed control unit 14, whereby the process proceeds from step S12 to step S13, where the middle speed extracting operation is performed. In concrete, the speed control unit 14, responsive to the high level signal from the eccentric load judging unit 16, outputs a speed designating signal so that the drum 54 is rotated at a middle speed N3. The inverter control circuit 20 applies voltage to the motor 22 according to the speed designating signal. The middle speed N3 is set at about 500 [r.p.m.] when the diameter of the drum is 700 [mm]. The middle speed extracting operation extracts water from the fabric articles roughly.

After the middle speed extracting operation, the process proceeds from step S13 to step S14, where the high speed extracting operation is performed. In concrete, the speed control unit 14 outputs a speed designating signal so that the drum is rotated at a high speed N4. The inverter control circuit 20 applies a voltage to the motor 22 according to the speed designating signal. The high speed N4 is set at about 700 [r.p.m.] when the diameter of the drum is 700 [mm]. It is preferable that the high speed N4 is determined corresponding to the extracting mode selected by the user according to the type of constituent fabric of the article or other factors.

If the magnitude of the eccentric load is out of the predetermined range or if the position of the eccentric load is not in the proximity to the position L2, the process steps from S10 to S12 are executed again and it is judged again whether the eccentric load is corrected by the oscillating operation as described above.

In the oscillating operation of step S10, the rotation can be controlled by methods other than that described above. In one of such methods, the drum 54 is first rotated in a direction opposite to that in the extracting operation at a speed of 10–20 [r.p.m.] by a rotation angle of about 90°, whereafter the direction is reversed and the drum 54 is rotated at the low speed N2. By this method, when the rotation of the drum 54 is reversed, the fabric articles move in the drum 54 by the reaction. It is preferable to select an appropriate method of oscillating the drum 54 regarding such factors as the diameter of the drum 54 and the height, shape and number of the baffles 58.

Figure 8:
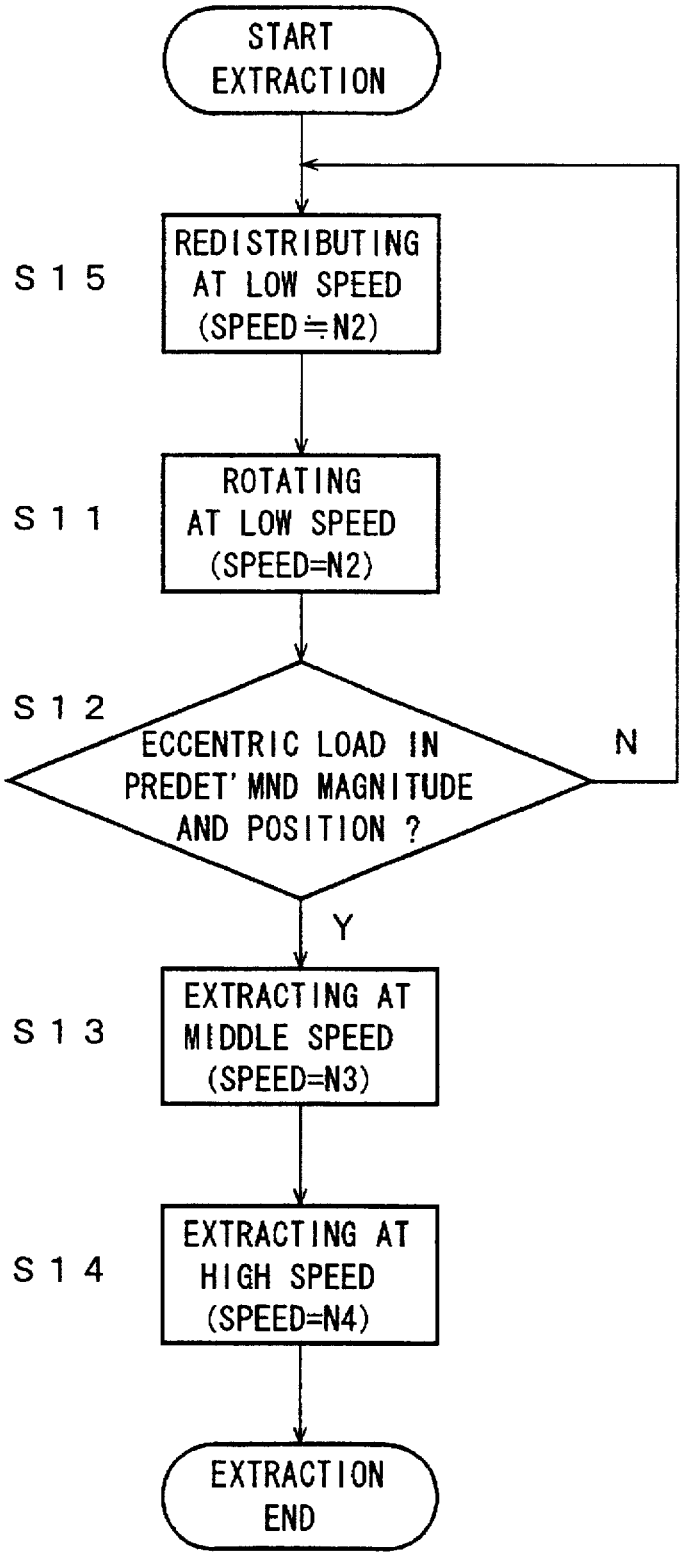
FIG. 8 is a flow chart showing a process of controlling the extracting operation in another embodiment.

The fabric articles may be prompted to move to a predetermined position by another method of rotating the drum, instead of oscillating the drum as describe above. FIG. 8 is a flow chart to explain the control method of an extracting process employing the second method of redistributing fabric articles. The flow chart of FIG. 8 is the same as that of FIG. 6 except that the former comprises, instead of the step S10 of FIG. 6, a step S15 for rotating the drum 54 at a speed close to the low speed N2.

In the step S15, the speed control unit 14 sets the speed of the drum 54 at a speed a little higher than a speed where the centrifugal force acting on the fabric articles is equal to the gravity force. Here, for example, the speed mat be the same as the low speed N2 at which the eccentric load is judged. At such a speed, the centrifugal force acting on the fabric articles is a little larger than the gravity force, so that the fabric articles are pressed on the inner peripheral wall of the drum 54. Then, the speed is changed within the proximity to the low speed N2 at every one or several rotations of the drum 54. As the speed changes, the fabric articles, pressed on the inner peripheral wall of the drum 54, shift on the wall.

By this method, when the redistributing operation is carried out in step S15, the drum 54 is rotated at a speed close to the speed at which the eccentric load is judged, therefore the steps S11 and S15 can be repeated more easily. In concrete, the redistributing operation is carried out for a short period of time in step S15, whereafter the eccentric load is judged in step S11 to detect the state of the eccentric load and, if necessary, the step S15 is carried out again to redistribute the fabric articles again. By repeating the above described process, the eccentric load can be corrected gradually, and when the eccentric load is settled in a desired state of magnitude and position, the process proceeds from step S12 to step S13.

Further, a third method for promptly redistributing fabric articles is explained as follows. Usually, fabric articles just after rinsed retain a lot of water and are on the lower part of the drum 54. Moreover, a plurality of fabric articles are entangled together, and it is difficult to redistribute them without loosening them. Hence, in the present method, the drum 54 is first rotated for a predetermined period of time at a speed where the centrifugal force acting on the fabric articles is smaller than the gravity force, thus loosening the fabric articles. After that, starting from the state where the balance weight 60 is positioned above the center of the drum 54, the speed of the drum 54 is increased to a speed where the centrifugal force acting on the fabric articles is a little larger than the gravity force, and the eccentric load is judged at the speed.

Whether a fabric article remains pressed on the inner peripheral wall of the drum 54 or falls down during the rotation depends substantially on the disparity between the centrifugal force and the gravity force acting on the fabric article. When two fabric articles having the same weight are rotating at the same speed, the centrifugal force acting on one fabric article positioned closer to the center of the drum 54 is smaller than that acting on the other article positioned closer to the inner peripheral wall. As a result, the fabric article positioned closer to the center of the drum 54 falls or shifts during the rotation before the speed of the drum 54 reaches the speed for detecting the eccentric load of the drum 54. Here, if the rotation of the drum 54 is accelerated in an appropriate manner as will be described later, most fabric articles are gathered in the proximity to the position L3 opposite at angle of 180° to the balance weight 60, and other fabric articles are distributed in other places of the inner peripheral wall of the drum 54, thus the eccentric load can be settled in the desired state more easily.

Figure 9:
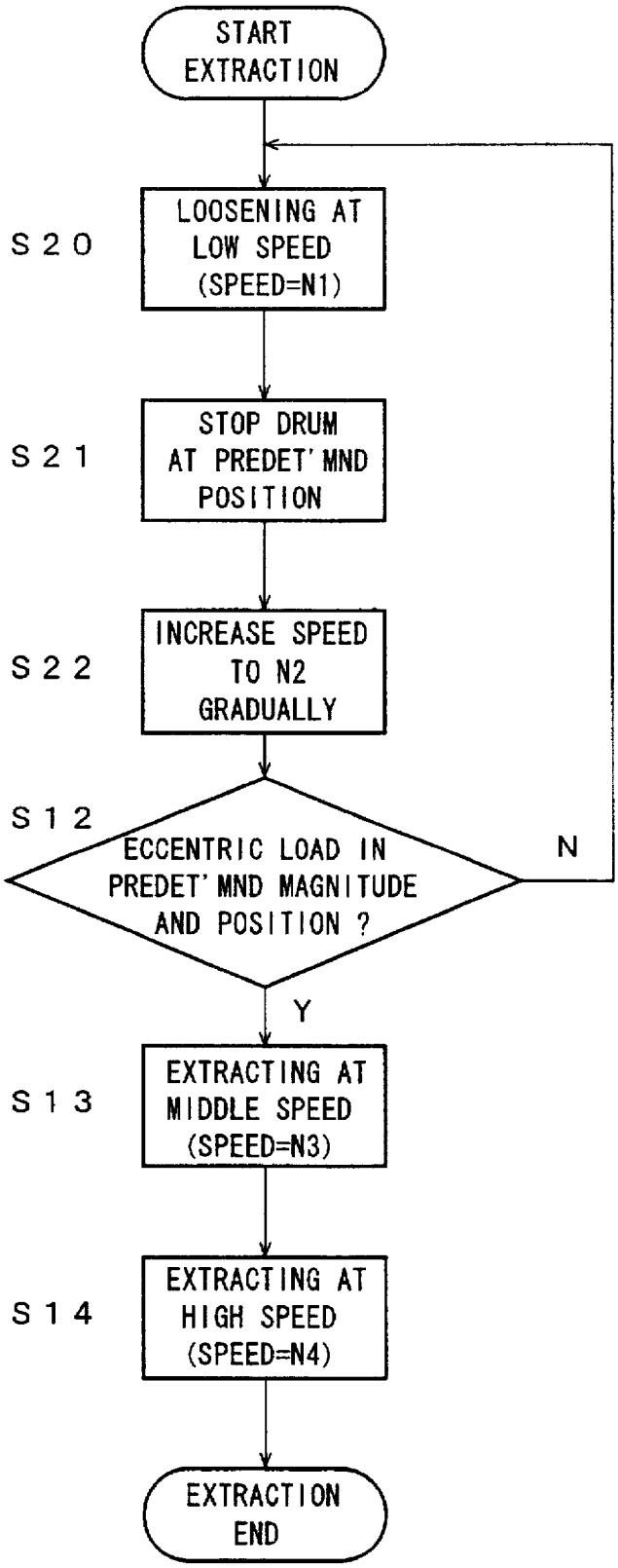
FIG. 9 is a flow chart showing a process of controlling the extracting operation in still another embodiment.

FIG. 9 is a flow chart showing the process for performing an extracting operation employing the third method. Here, the weight of the balance weight 60 is assumed to be 300 [g] and the maximum eccentric load allowable after the extracting process be 100 [g].

Figure 10A:
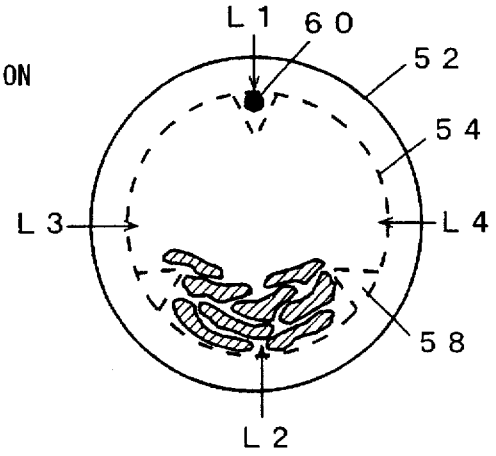
FIGS. 10A, 10B, 10C and 10D illustrate a movement of the fabric articles in the drum in the extracting operation by the process of the flow chart of FIG. 9.

Just before the extracting process is started, the fabric articles are crammed and piled on the lower part of the drum 54, as shown in FIG. 10A. When the extracting process starts, a loosening and unbinding operation is carried out first on the fabric articles (step S20). In concrete, the speed control unit 14 outputs a speed designating signal so that the drum 54 is rotated at a low speed N1 where the gravity force is a little larger than the centrifugal force acting on the fabric articles. The inverter control circuit 20 applies voltage to the motor 22 according to the speed designating signal. The low speed N1 is set at about 20 [r.p.m.] when the diameter of the drum is 700 [mm], and at about 30 [r.p.m.] when the diameter is 910 [mm].

Figure 10B:
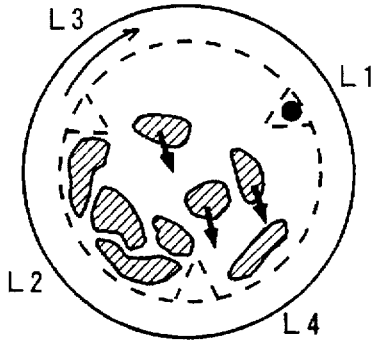

When the drum 54 is rotated at a speed as described above, the fabric articles are stirred up as shown in FIG. 10B, whereby the entangled fabric articles become loose and air is introduced between the fabric articles as well as inside of each fabric article. Therefore, when the drum 54 is stopped temporarily after the loosening operation is carried out for a predetermined period of time (step S21), the outside volume of the fabric articles is larger than that before loosened. In such a loosened state, every fabric article is easier to be separated. Furthermore, in the state of the increased outside volume, the variation in the distances between every fabric article and the central axis of the drum 54 is expanded.

Figure 10C:
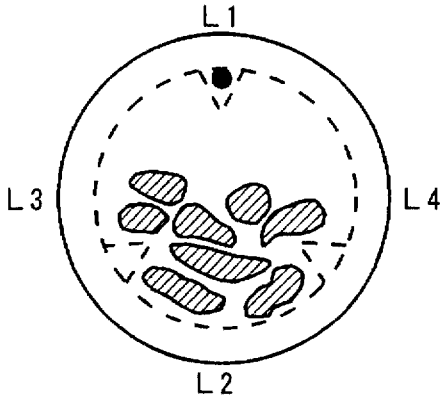

Next, starting from the state where the balance weight 60 is positioned at the top as shown in FIG. 10C, the drum 54 is rotated in the direction opposite to that in the loosening operation. The speed of the drum 54 is gradually increased to the low speed N2 for judging the eccentric load (step S22). In concrete, the speed control unit 14 increases the value of the speed designating signal step by step to a value corresponding to the low speed N2. The inverter control circuit 20 applies voltage to the motor 22 according to the speed designating signal.

In increasing the speed of the drum 54 to the low speed N2, the following points should be considered. When the drum 54 is accelerated too fast, the fabric articles are not redistributed but remain gathering near the position L2. Further, the fabric articles as a whole slide in the direction opposite to the rotation, i.e., towards the position L3 in FIG. 10D due to the sudden acceleration, thus an adequate load balance cannot be attained. On the other hand, when the drum 54 is accelerated too slowly, an adequate load balance cannot be attained either though the fabric articles may be redistributed to some extent, because the fabric articles near the position L2 slide forwards, i.e., towards the position L4 in FIG. 10D, due to the gravity force when the drum 54 is rotated at a speed a little lower than the speed at which the centrifugal force and the gravity force are equal on the fabric article pressed on the inner peripheral wall of the drum 54. Thus, for example, when the total weight of the fabric articles is 6 [kg], the diameter of the drum is 910 [mm] and the low speed N2 is 86 [r.p.m.], then the acceleration is set at 1.2–2.4 [$\pi$rad/s$^2$] so that the speed of the drum is increased to the low speed N2 in 1.2–2.4 [s] from the start.

Figure 10D:
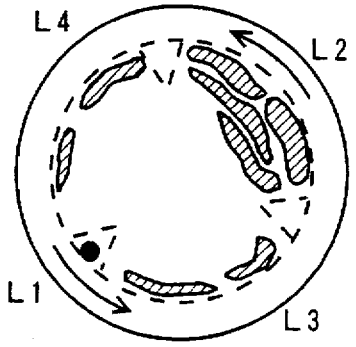

When the speed of the drum 54 reaches the low speed N2, all the fabric articles are pressed on the inner peripheral wall of the drum 54 (FIG. 10D). Here, the magnitude and position of the eccentric load is judged as described above (step S12), and when predetermined conditions are satisfied, the process further proceeds from step S13 to step S14, where the middle speed extracting operation and the high speed extracting operation are performed.

In the preceding argument, the weight of each fabric article is assumed to decrease to ½ through the extracting operation. Practically, the water absorbing ratio of a fabric article depends considerably on the type of constituent fabric and on the method of knitting (or weaving or the like), and each fabric article accordingly has its own weight-decreasing ratio. When there are several fabric articles having different weight-decreasing ratios, the following phenomenon occurs in redistributing the fabric articles.

Figure 11A:
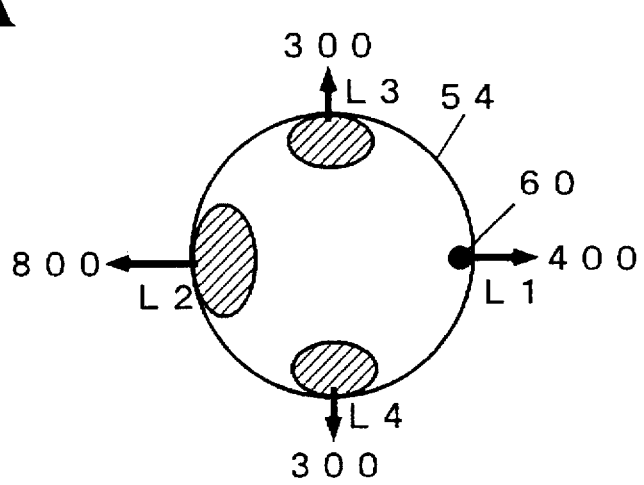
FIGS. 11A, 11B and 11C illustrate three different cases where fabric articles at different positions in the drum have different weight-decreasing ratios in an extraction process.
Figure 11B:
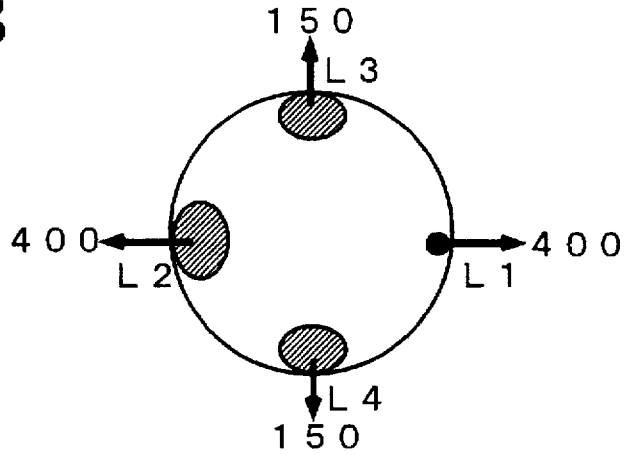

In the first case, it is assumed that the weight of the balance weight 60 is 400 [g], wet fabric articles weighing total 1.4 [kg] including water are contained in the drum 54, and the weight of each fabric article decreases to ½ through the extracting operation. Before the extracting operation, the fabric articles are assumed to be distributed in the drum such that: no mass is present at the position L1, 800 [g] mass at L2, 300 [g] mass at L3, and 300 [g] mass at L4, which totals 1.4 [kg]. In this case, the magnitude of the eccentric load is 400 [g] and the its position is in the proximity to the position L2 (FIG. 11A). According to the assumption, the weight of each fabric article decreases to ½ through the extracting operation, so that the mass distribution after the extracting operation is as follows: no mass is present at the position L1, 400 [g] mass at L2, 150 [g] mass at L3, and 150 [g] mass at L4. As a result, no eccentric load exists since the load of all the fabric articles is completely balanced with that of the balance weight 60 (FIG. 11B).

Figure 11C:
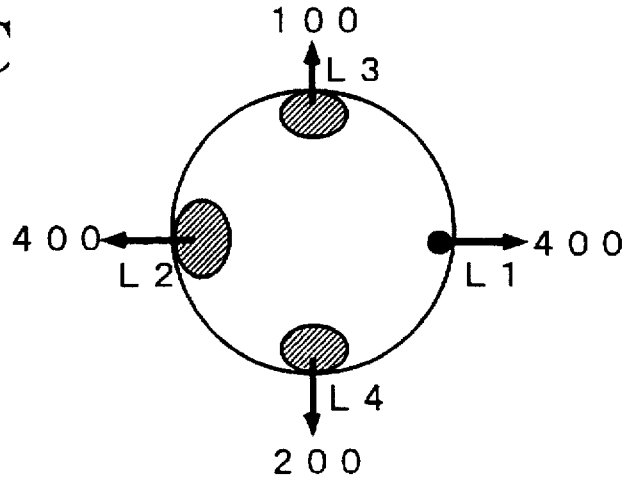

In the second case, wet fabric articles weighing total 1.4 [kg] are contained in the drum 54 and the mass distribution of the fabric articles is such that: no mass is present at the position L1, 800 [g] mass at L2, 300 [g] mass at L3, and 300 [g] mass at L4, as in the above case. Now, however, the fabric articles are assumed to have different water absorbing ratios. That is, the weight of the fabric article (or articles) placed at the position L2 decreases to ½, that at L3 decreases to ⅓, and that at L4 decreases to ⅔ through the extracting operation. In this case, the mass distribution after the extracting operation results in such that: no mass is present at the position L1, 400 [g] mass at L2, 100 [g] mass at L3, and 200 [g] mass at L4. Here, eccentric load of 100 [g] exists at the position L4 (FIG. 11C). Thus, even if the mass distribution is the same at the time when the eccentric load is judged, both the magnitude and position of the eccentric load may change through the extracting operation.

The above-described problem occurs when fabric articles having different weight-decreasing ratios are distributed irregularly in the drum 54. If, on the other hand, the fabric articles are initially distributed so that those having high weight-decreasing ratio are placed at the position L2 and those having low weight-decreasing ratio are placed at the positions L3 and L4, such shift of the eccentric load as explained above can be prevented. Such initial distribution can be attained if the fabric articles can be separated according to the water absorbing ratio before the redistributing operation, that is, the eccentric load is balanced with fabric articles having high water absorbing ratio gathered in the position opposite at angle of 180° to the balance weight 60.

Figure 12:
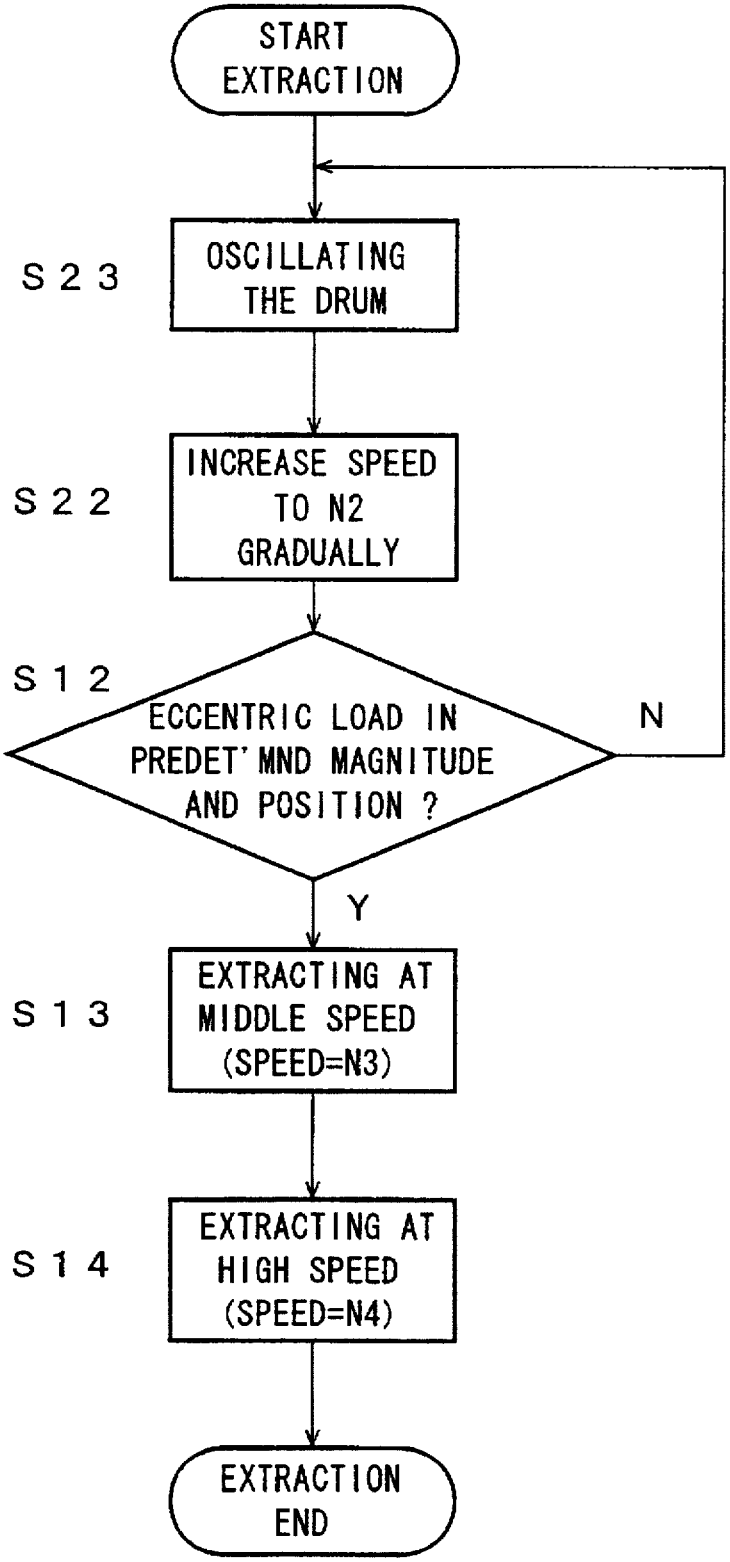
FIG. 12 is a flow chart showing a process of controlling the extracting operation in another embodiment.

The process of carrying out the extracting operation including the above-described redistributing method is explained as follows, referring to the flow chart of FIG. 12.

Figure 13A:
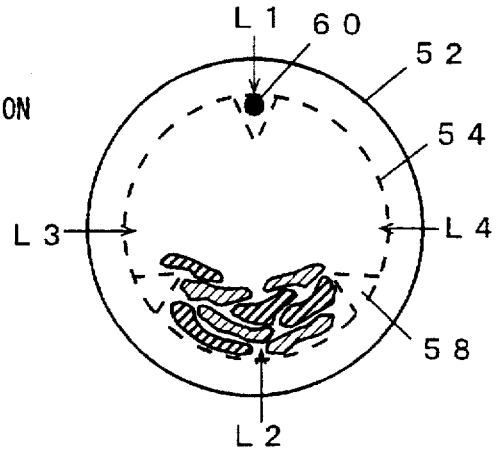
FIGS. 13A, 13B, 13C and 13D illustrate a movement the fabric articles in the drum in the extracting operation by the process of the flow chart of FIG. 12.

Just before the extracting process is started, the fabric articles are crammed and piled on the lower part of the drum 54, as shown in FIG. 13A. To separate the fabric articles according to the water absorbing ratio, an oscillating operation is carried out (step S23). In concrete, the speed control unit 14 outputs speed designating signals to perform the oscillating operation described below, and the inverter control circuit 20 applies voltage to motor according to the speed designating signal.

Figure 13B:
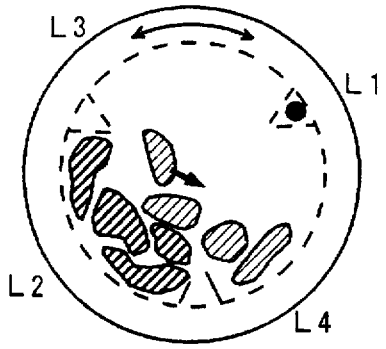

Starting from the state where the drum is halted with the balance weight 60 approximately at the top, the drum 54 is first oscillated forward and backward with an angle of about 90°–120°. The oscillation is repeated a few times, and the oscillating speed is determined so that the cycle time of an oscillation is about 1–2 seconds, whereby some of the fabric articles in the drum 54 move beyond the baffles 58 (FIG. 13B). Next, again starting from the state where the drum is halted with the balance weight 60 approximately at the top, the drum 54 is oscillated forward and backward with a smaller angle of about 30°–45°. The oscillation is repeated about ten times, and the oscillating speed is determined so that the cycle time of an oscillation is about 0.5 seconds or less, whereby the fabric articles between the two baffles 58 at the lower part of the drum 54 are shaken forward and backward. By the above two oscillating operations, fabric articles that absorb more water and have larger specific gravity sink down onto the bottom of the drum 54 while fabric articles that absorb less water and have smaller specific gravity emerge up. Thus, the fabric articles are separated into the upper and lower groups according to the water absorbing ratio.

Next, starting from the state where the balance weight 60 is halted approximately at the top, the drum 54 is accelerated until its speed reaches the low speed N2 for judging the eccentric load (step S22). In concrete, the speed control unit 14 increases the value of the speed designating signal step by step up to a value corresponding to the low speed N2. The inverter control circuit 20 applies voltage to the motor 22 according to the speed designating signal.

Figure 13C:
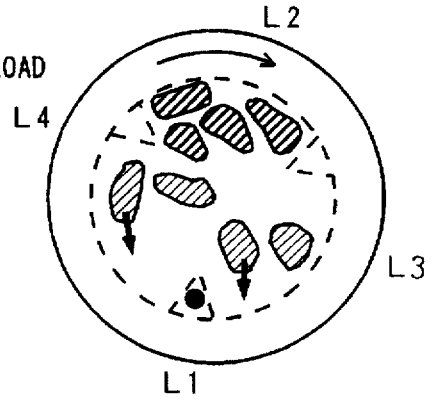

The centrifugal force acting on a fabric article is smaller as the fabric article is closer to the rotation center of the drum 54. Therefore, there exists such a speed, which is lower than the low speed N2, where the centrifugal force acting on fabric articles positioned closer to the center of the drum 54 is smaller than the gravity force while the centrifugal force acting on fabric articles positioned closer to the peripheral wall of the drum 54 is larger than the gravity force. At such a speed, the fabric articles having smaller specific gravity falls or shifts in the course of the rotation (FIG. 13C). As a result, the fabric articles having larger specific gravity remain around the position L2 opposite at angle of 180° to the balance weight 60 while the fabric articles having smaller specific gravity are distributed on the other places of the inner peripheral wall of the drum 54. In the process of accelerating the drum 54 until its speed reaches the low speed N2, the fabric articles can be redistributed appropriately under the same condition as described referring to FIG. 9.

Figure 13D:
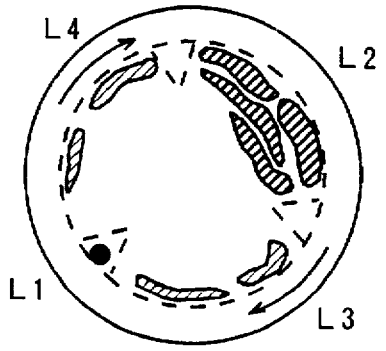

After the speed of the drum 54 reaches the low speed N2, all the fabric articles are pressed on the inner peripheral wall of the drum 54 (FIG. 13D), and the magnitude and position of the eccentric load are judged by the eccentric load judging unit 16, as previously described (step S12). When the eccentric load satisfies the required conditions there, the process proceeds from step S13 to step S14, where the middle speed extracting operation and the high speed extracting operation are performed.

Figure 14:
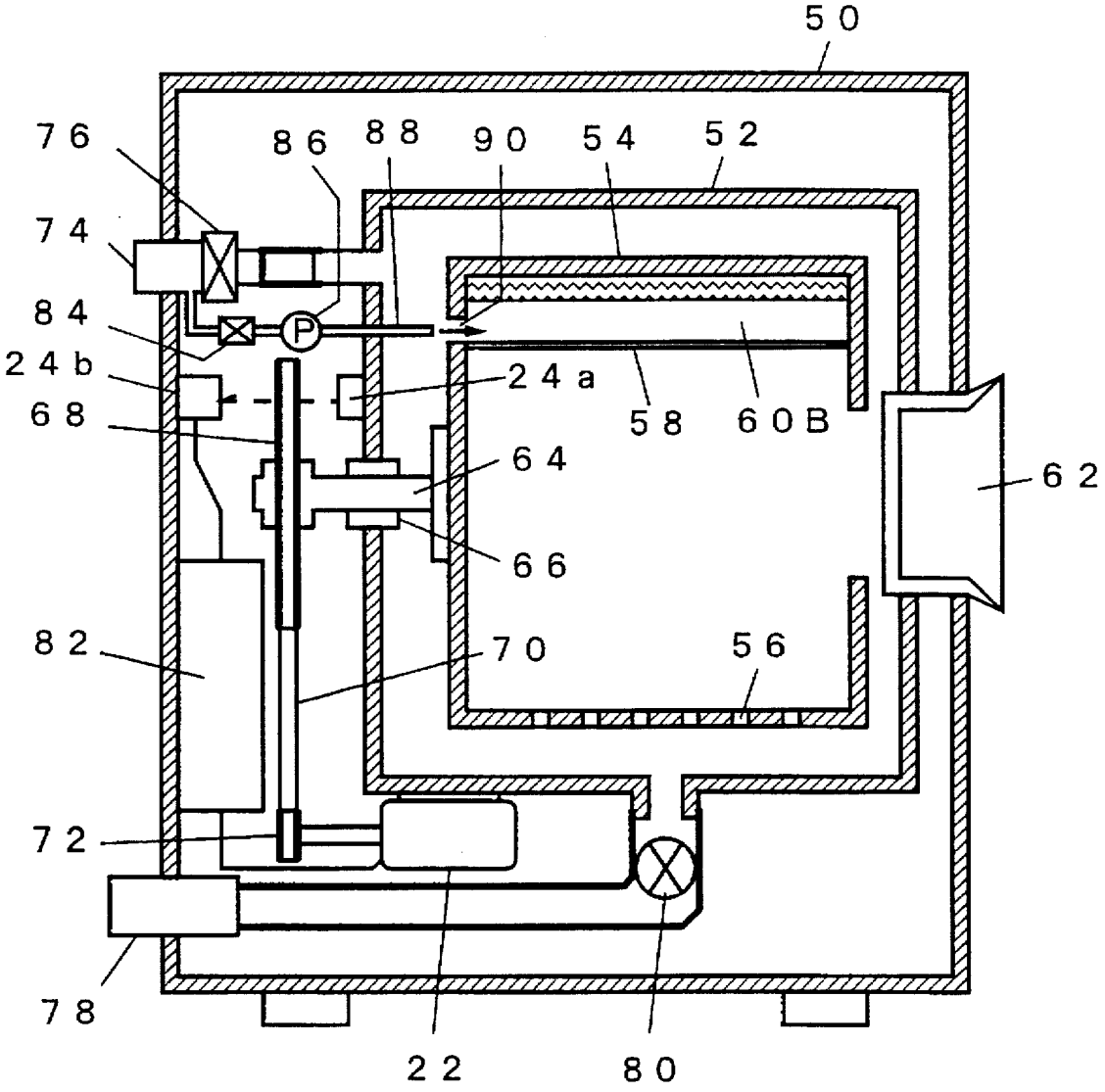
FIG. 14 is a vertical cross sectional view of a drum type washing machine equipped with a spin extractor as another embodiment of the present invention.
Figure 16:
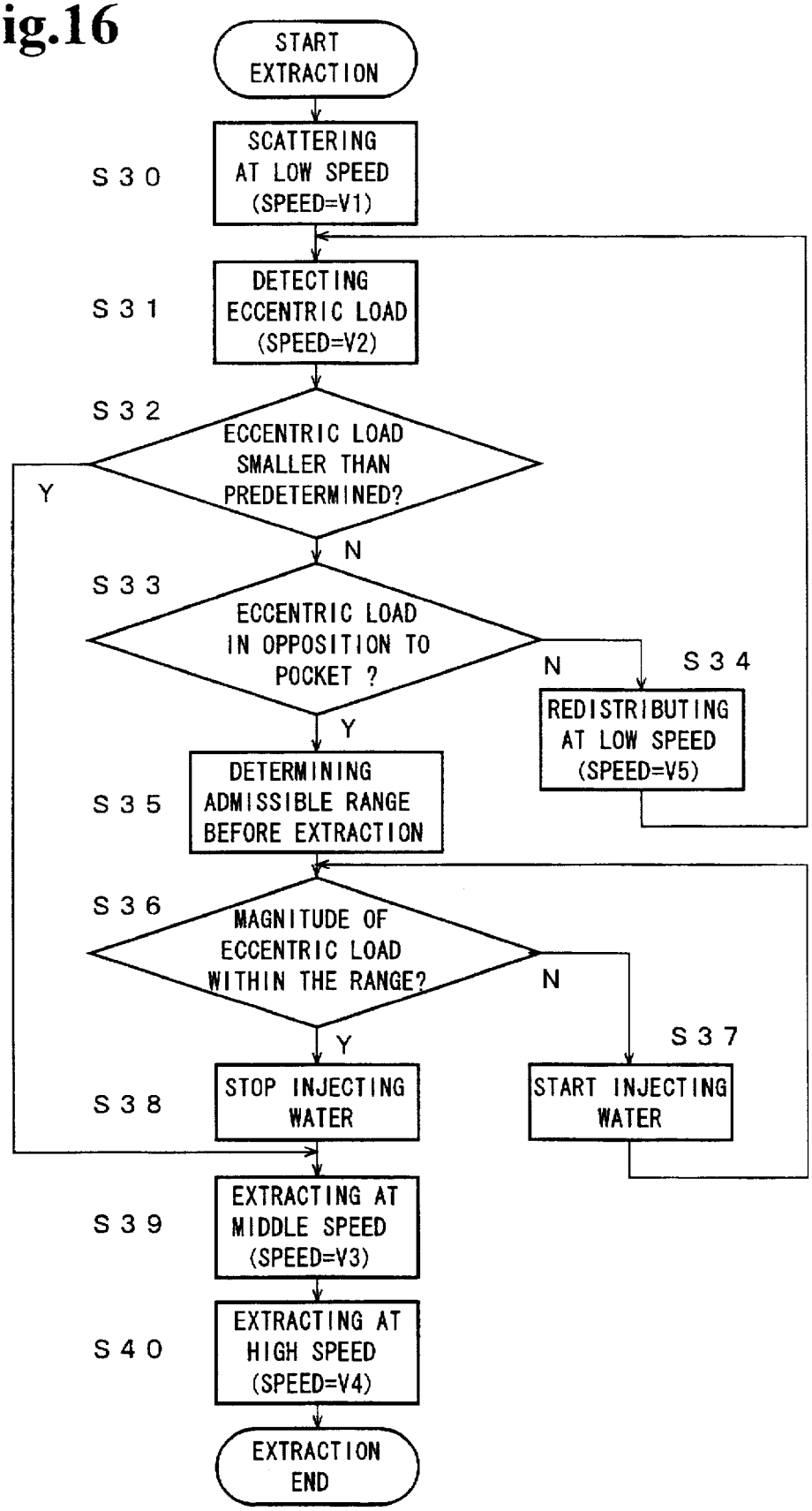
FIG. 16 is a flow chart showing the process of controlling the extracting operation in the embodiment of FIG. 14.
Figure 17A:
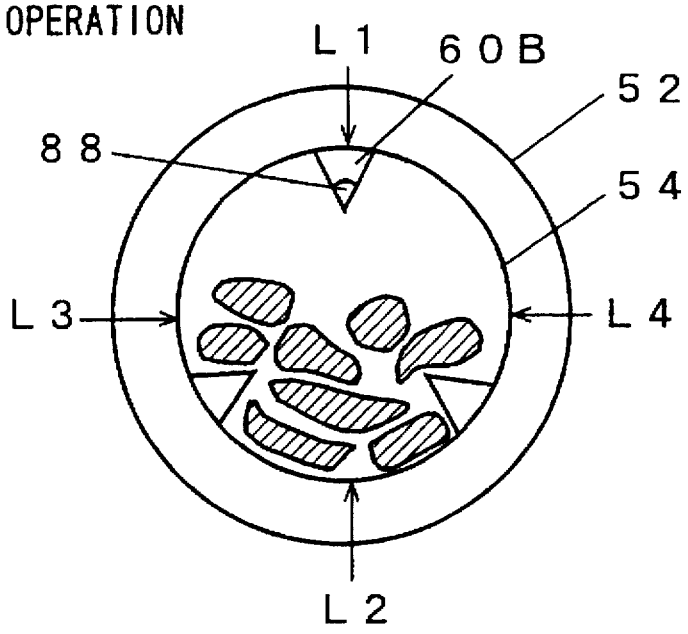
FIGS. 17A and 17B illustrate a movement of the fabric articles in the drum in the extracting operation of the flow chart of FIG. 16.
Figure 17B:
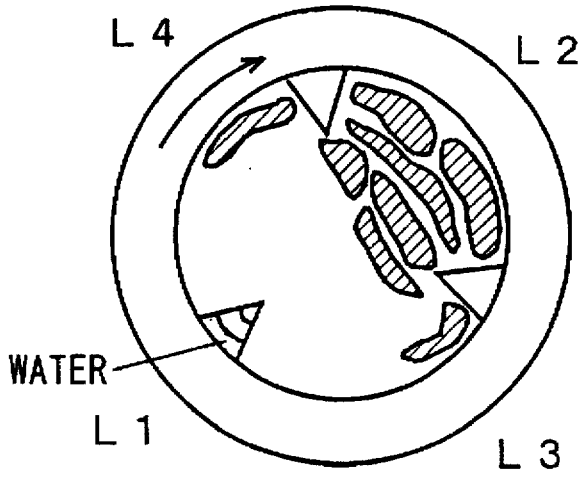

In all the above embodiments, the balance weight 60 is assumed to have a fixed weight. Now, a spin extractor having a variable weight is disclosed in the following embodiment. FIG. 14 shows a vertical cross section of a drum type washing machine including a spin extractor according to the present invention, FIG. 15 shows a schematic block diagram of the electric system of the spin extractor, FIG. 16 shows a flow chart for explaining a process of controlling the extracting operation, and FIGS. 17A and 17B show the movement of fabric articles in the drum.

First, the structure of the spin extractor of the present embodiment is described referring to FIG. 14 in comparison with that of FIG. 1. Three baffles 58 for lifting fabric articles with the rotation of the drum 54 are provided on the inner peripheral wall of the drum 54 at angular intervals of 120°. A pocket 60B for storing water is provided inside one of the baffles 58. A part of the water supplied from the water inlet 74 is supplied via a weight water supply valve 84 to a water jet pump 86. The water is pumped by the water jet pump 86 and injected from an injection nozzle 88 through an injection port 90 into the pocket 60B. The injection port 90 is formed in one end of the pocket 60B at the position closer to the center of the drum 54. When the drum 54 is rotating at a speed where the centrifugal force acting on the water in the pocket 60B is larger than the gravity force, the water in the pocket 60B does not spill out from the injection port 90, and when the drum 54 is rotating at a speed where the centrifugal force acting on the water in the pocket 60B is smaller than the gravity force, the water in the pocket 60B spills out from the injection port 90 at the moment the pocket 60B comes to the top.

Figure 15:
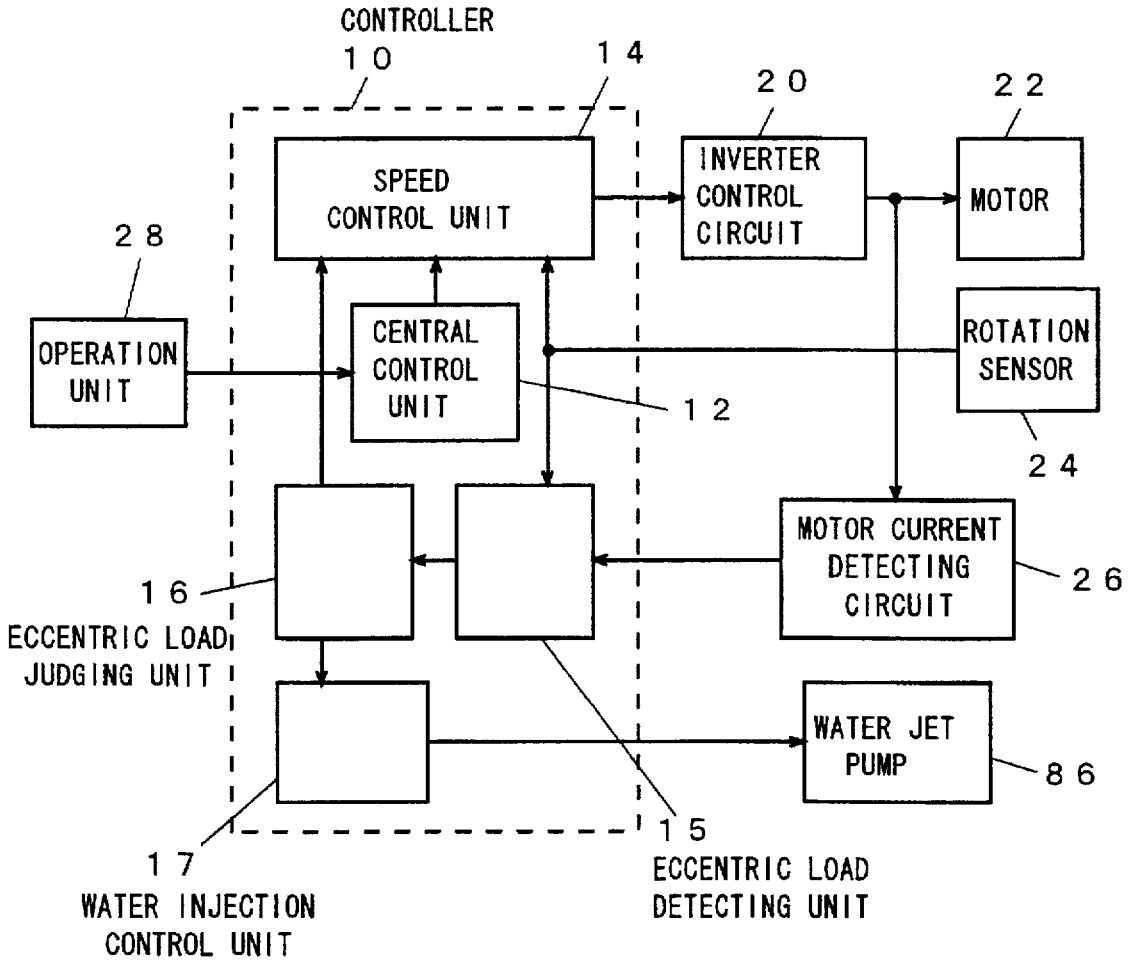
FIG. 15 is a schematic block diagram of the electric system of the spin extractor of the embodiment of FIG. 14.

Next, the constitution and operation of the electric system is described referring to FIG. 15. An eccentric load detecting unit 15 detects the magnitude and position of the eccentric load referring to the signal from the motor current detecting circuit 26, and the data of the magnitude and position is sent to the eccentric load judging unit 16. The eccentric load judging unit 16 judges whether the position of the eccentric load is within a desirable range on the inner peripheral wall of the drum 54. The desirable range is an allowable range predetermined in the proximity to the position opposite at angle of 180° to the baffle 58 having the pocket 60B. In predetermining the desirable range, such factors as the error in detecting the position and unevenness in the distribution of the fabric articles are taken into account. The eccentric load judging unit 16 further judges whether the magnitude of the eccentric load is within a predetermined range. The predetermined range is an allowable range predetermined according to such factors as the allowable range of the eccentric load after the extracting operation, the weight of water injected into the pocket 60B, i.e., the eccentric load of the drum 54 itself.

The results of the judgement by the eccentric load judging unit 16 are sent to both the speed control unit 14 and a water injection control unit 17. The speed control unit 14 outputs a speed designating signal to change the speed of the motor 22 according to the results of the judgement on the eccentric load. The water injection control unit 17 drives the water jet pump 86 to start and stop injecting water from the injection nozzle 88 into the pocket 60B according to the results of the judgement.

In the present spin extractor, the water stored in the pocket 60B functions as a balance weight, and the load balance can be changed by varying the amount of the water in the pocket 60B.

The process of carrying out the extracting operation is described as follows referring to FIG. 16. Here, the maximum eccentric load allowable after the extracting operation is assumed to be 200 [g].

The distribution of fabric articles in the drum 54 is as shown in FIG. 17A at the beginning of the extracting process after the rinsing process is finished. Here, the drum 54 has no eccentric load of its own since water is not injected into the pocket 60B. Starting from there, a distributing operation is first carried out at a low speed so that the fabric articles are stirred up and distributed on the inner peripheral wall of the drum 54 (step S30). In concrete, the speed control unit 14 outputs a speed designating signal so that the drum 54 is rotated at a first speed V1 where the centrifugal force acting on the fabric articles is smaller than the gravity force. The inverter control circuit 20 applies voltage to the motor 22 according to the speed designating signal. It is appreciated to make the speed fluctuate in the proximity to the speed V1 to help the fabric articles move in the drum 54.

Next, a detecting operation is carried at a low speed to detect the eccentric load due to the uneven distribution of the fabric articles (step S31). In concrete, the speed control unit 14 outputs a speed designating signal so that the drum 54 is rotated at a second speed V2 which is higher than the speed where the centrifugal force acting on the fabric articles is equal to the gravity force. The inverter control circuit 20 applies voltage to the motor 22 according to the speed designating signal.

After the speed of the drum 54 reaches the second speed V2, the eccentric load detecting unit 15 detects the magnitude and position of the eccentric load. In concrete, the eccentric load detecting unit 15 detects the magnitude of the eccentric load based on the amplitude of the fluctuations in the motor current detected by the motor current detecting circuit 26, and further detects the position of the eccentric load based on the position of the peak of the fluctuation. Then, the eccentric load judging unit 16 judges whether the magnitude of the eccentric load is smaller than a predetermined value (step S32). The predetermined value is set at the maximum magnitude of eccentric load that causes no abnormal vibration in the extracting operation. When the magnitude of the eccentric load is smaller than predetermined, it is judged that the fabric articles are distributed almost evenly in the drum 54 by the distributing operation, therefore the process jumps from step S32 to step S39 where an extracting operation described later is carried out.

When the eccentric load is larger than predetermined, the process proceeds from step S32 to step S33, where the position of the eccentric load is judged. In concrete, it is judged whether the position of the eccentric load is in the proximity to the position L2 opposite at an angle of 180° to the position L1 where the pocket 60B is provided. When the position of the eccentric load is not in the proximity to the position L2, the process proceeds from step S33 to step S34, where a low speed redistributing operation is performed. Here, for example, the drum 54 is rotated at a speed V5 where the centrifugal force acting on the fabric articles is smaller than the gravity force. The speed V5 may be set at V1 or between V1 and V2. Further, it is favored to observe the rotational position of the drum 54 through the rotation sensor 24 in controlling the rotation so that the eccentric load comes to a desired position, whereby the fabric articles can be redistributed more reliably. Here, the above-described various methods of redistributing the fabric articles can be employed. After the redistributing operation, the process goes back to step S31.

When the position of the eccentric load is in the proximity to the position L2, the process proceeds from step S33 to step S35, where the water injection control unit 17 determines an allowable range of the eccentric load according to the eccentric load detected as above. The allowable range is determined as follows.

When the eccentric load after the extracting process is to be settled under P [g], the condition for the eccentric load to be within the allowable range before the extracting process is as shown by the formula (10). Provided that P=200 [g] and Q=200 [g], the formula (10) is rewritten as follows:

$$200 \leqq (m2-m1)-M \leqq M+400 \quad (11).$$

Here, (m2−m1) is the magnitude of the eccentric load when the drum 54 has no eccentric load of its own, i.e., it corresponds to the magnitude of the eccentric load detected in step S31. Accordingly, the eccentric load judging unit 16 calculates the range of the magnitude of the eccentric load that satisfies the formula (11) (step S35).

For example, when wet fabric articles weighing 1 [k] is contained in the drum 54, and the mass distribution in the drum 54 after the redistributing operation is such that: no mass is present at the position L, 800 [g] mass at L2, 100 [g] mass at L3, and 100 [g] mass at L4. Here, (m2−m1)=800 [g], and the formula (11) is rewritten as follows:

$$200 \leqq M \leqq 600.$$

Under the above formula, the allowable range of the eccentric load is as follows:

$$200 \leqq m2-(m1+M) \leqq 600 \quad (12).$$

Next, the eccentric load judging unit 16 judges whether the magnitude of the eccentric load is within the allowable range determined as above (step S36). In the above example, the magnitude of the eccentric load is 800 [g] when no water is stored in the pocket 60B and accordingly no balance weight is provided to the drum 54. Here the formula (12) is not satisfied, so that the process proceeds from step S36 to step S37, where the injection of water is started. In concrete, on receiving the results of the judgement from the eccentric load judging unit 16 that the magnitude of the eccentric load is out of the predetermined allowable range, the water injection control unit 17 opens the weight water supply valve 84 and instructs the water jet pump 86 to start injecting water from the injection nozzle 88. Here the speed of the drum 54 is maintained at the second speed V2. At this speed, while the eccentric load is being detected, the water is injected from the injection nozzle 88.

When the drum 54 is rotated and the baffle 58 having the pocket 60B comes to the top, the water jetted out from the injection nozzle 88 is injected through the injection port 90 into the pocket 60B. The water injected into the pocket 60B is retained in the pocket 60B, pressed on the inner peripheral wall of the drum 54 by the centrifugal force. The weight of the water increases as the drum 54 rotates and, accordingly, the magnitude of the eccentric load detected there gradually decreases and finally comes to satisfy the formula (12). Then, the process proceeds from step S36 to step S38, where the weight water valve 84 is closed and the water jet pump 86 is stopped. Subsequently, the process proceeds from step S38 via step S39 to step S40, where the middle speed extracting operation with speed V3 and the high speed extracting operation with speed V4 are performed, and the extracting operation comes to the end. The speeds V3 and V4 correspond to the speeds N3 and N4 of steps. S13 and S14 of FIG. 9 and are similarly determined.

After the extracting operation is finished, the drum 54 is stopped, and when the centrifugal force acting on the water stored in the pocket 60B becomes smaller than the gravity force, the water spills out from the injection port 90 at the moment the pocket 60B comes to the top, and the drum 54 restores its original state of no eccentric load.

In the above embodiment, when the speed V2 is determined closer to the speed V5, the steps from S31 to S34 can be repeated in a shorter time. In this case, after redistributing the fabric articles in step S34, the eccentric load is detected and judged in steps S31 to S33, thus checking the state of the eccentric load. Then, if necessary, the redistributing operation is carried out again in step S34. By repeating the above-described process, the eccentric load is corrected gradually toward the desirable state, and when the position of the eccentric load is settled within a predetermined range, the process proceeds from step S33 to step S35.

In addition, the spin extractor according to the present invention can be applied not only to an aqueous washing machine but also to a dry cleaning machine as a liquid extractor for extracting liquid such as petroleum solvent.

What is claimed is:

1. A spin extractor for extracting liquid from fabric articles contained in a drum by rotating the drum about a horizontal axis, the spin extractor comprising:

a) a fixed weight attached to the drum for providing a fixed eccentric load to the drum;

b) a motor for rotating the drum;

c) detecting means for detecting a magnitude and a position of a resultant eccentric load composed of the fixed eccentric load of the drum and a load by the fabric articles contained in the drum;

d) judging means for judging whether the magnitude of the resultant eccentric load is within a predetermined range and whether the position of the resultant eccentric load is within a predetermined proximity to a predetermined position; and e) speed control means for driving the motor to rotate the drum at a first speed for performing an extracting operation on the fabric articles if the magnitude of the resultant eccentric load is judged to be within the predetermined range and the position of the resultant eccentric load is within the predetermined proximity to the predetermined position, and for driving the motor to rotate the drum at a second speed for redistributing the fabric articles in the drum if the magnitude of the resultant eccentric load is judged to be not within the predetermined range or the position of the resultant eccentric load is judged to be not within the predetermined proximity to the predetermined position.

2. A spin extractor for extracting liquid from fabric articles contained in a drum by rotating the drum about a horizontal axis, the spin extractor comprising:

a) a variable weight attached to the drum for providing a variable eccentric load to the drum;

b) a motor for rotating the drum;

c) detecting means for detecting a magnitude and a position of a resultant eccentric load composed of the eccentric load of the drum and a load by the fabric articles contained in the drum;

d) adjusting means for adjusting the variable weight according to the magnitude of the resultant eccentric load detected by the detecting means at a time when a magnitude of the variable weight is zero if the position of the resultant eccentric load is within a predetermined proximity to a position determined with respect to the position of the variable weight in the drum at a time when the magnitude of the variable weight is zero; and e) speed control means for driving the motor to rotate the drum at a speed for performing an extracting operation on the fabric articles if the magnitude of the resultant eccentric load is detected to be within a predetermined range after the variable weight is adjusted by the adjusting means.

3. A spin extractor according to claim 2, wherein the speed control means drive the motor to bring the resultant eccentric load within the predetermined proximity by redistributing the fabric articles in the drum if the position of the resultant eccentric load is not within the predetermined proximity.

4. A spin extractor according to claim 1, wherein the spin extractor further comprises rotational position detecting means for detecting a rotational position of the drum, and, in redistributing the fabric articles, the speed control means drive the motor to rotate the drum at a speed within a range where a centrifugal force acting on the fabric articles is smaller than a gravity force acting thereon referring to the rotational position of the drum.

5. A spin extractor according to claim 1, wherein, in redistributing the fabric articles, the speed control means vary the speed of the drum within a range where a centrifugal force acting on the fabric articles is larger than a gravity force acting thereon.

6. A spin extractor according to claim 5, wherein the speed control means set the range at a little higher than a speed where the centrifugal force is equal to the gravity force.

7. A spin extractor according to claim 1, wherein the speed control means oscillate the drum forward and backward for a predetermined period of time, maintaining position of the eccentric load of the drum above a center of the drum, in the initial phase of the extracting process, and then increase the speed of the drum until a centrifugal force acting on the fabric articles becomes a little larger than a gravity force acting thereon.

8. A spin extractor according to claim 7, wherein the speed control means carry out the following two oscillating operations alternately: one to oscillate the drum with an angle larger than 90°, and the other to oscillate the drum with an angle smaller than 90°.

9. A spin extractor according to claim 1, wherein the speed control means carry out the following sequential process: first to rotate the drum for a predetermined period of time at a speed within a range where a centrifugal force acting on the fabric articles is smaller than a gravity force acting thereon, second to decrease the speed until the drum completely halts or nearly halts, and third, starting from the state where the position of the fabric articles is in opposition to the eccentric load of the drum, to increase the speed of the drum to a speed where the centrifugal force is larger than the gravity force.

10. A spin extractor according to claim 9, wherein the drum is rotated in one direction when it is rotated at a speed where the centrifugal force is smaller than the gravity force, and the drum is rotated in another direction when it is rotated at another speed where the centrifugal force is larger than the gravity force.

11. A spin extractor according to claim 1, wherein the detecting means detect the magnitude of the resultant eccentric load from an amplitude of fluctuations in an electric current to the motor, and detect the position of the resultant eccentric load from a position of a peak in the fluctuations.

12. A spin extractor according to claim 11, wherein, while the detecting means detect the resultant eccentric load, the speed control means rotate the drum at a speed a little higher than a speed where the centrifugal force is equal to the gravity force.

13. A spin extractor according to claim 2, wherein the variable weight consists of a pocket with a liquid contained therein, and the variable eccentric load is varied by changing an amount of the liquid.

14. A spin extractor according to claim 13, wherein the pocket is formed in a baffle of the drum.

15. A spin extractor according to claim 13, wherein the pocket has a liquid port formed at such a position that the liquid is kept inside by a centrifugal force acting on the liquid when the drum is rotating at a speed where the centrifugal force acting on the fabric articles is larger than the gravity force acting on the fabric articles and that the liquid is discharged through the liquid port when the drum is rotating at a speed where the centrifugal force acting on the fabric articles is smaller than the gravity force acting on the fabric articles.

* * * * *